US011455937B2

(12) United States Patent
Seo

(10) Patent No.: US 11,455,937 B2
(45) Date of Patent: Sep. 27, 2022

(54) DISPLAY DEVICE

(71) Applicant: Samsung Display Co., Ltd., Yongin-Si (KR)

(72) Inventor: Hae-Kwan Seo, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/306,100

(22) Filed: May 3, 2021

(65) Prior Publication Data

US 2022/0044620 A1 Feb. 10, 2022

(30) Foreign Application Priority Data

Aug. 4, 2020 (KR) ..... 10-2020-0097623

(51) Int. Cl.
*G09G 3/3225* (2016.01)
*G09G 3/20* (2006.01)

(52) U.S. Cl.
CPC ... *G09G 3/2092* (2013.01); *G09G 2310/0278* (2013.01)

(58) Field of Classification Search
CPC ..... G09G 3/2092; G09G 2310/0278; G09G 2310/0267; G09G 2310/0286; G09G 2330/021; G09G 2340/0435; G09G 3/2022; G09G 3/2085; G09G 2230/00
See application file for complete search history.

(56) References Cited

U.S. PATENT DOCUMENTS

| | | | | |
|---|---|---|---|---|
| 9,613,554 | B2 | 4/2017 | Jang et al. | |
| 9,697,758 | B2 | 7/2017 | Watanabe et al. | |
| 9,721,525 | B2 | 8/2017 | Park et al. | |
| 10,338,727 | B2 * | 7/2019 | Yu | G06F 3/04184 |
| 10,373,575 | B2 * | 8/2019 | Park | G09G 3/3666 |
| 10,615,240 | B2 | 4/2020 | Song et al. | |
| 10,636,356 | B1 * | 4/2020 | Qian | G09G 3/3275 |
| 10,706,785 | B2 * | 7/2020 | Kim | G05D 3/10 |
| 2004/0001054 | A1 * | 1/2004 | Nitta | G09G 3/3648 345/204 |
| 2005/0062733 | A1 * | 3/2005 | Morita | G09G 3/3688 345/204 |

(Continued)

FOREIGN PATENT DOCUMENTS

| | | | |
|---|---|---|---|
| KR | 1020160017250 | A | 2/2016 |
| KR | 1020160128547 | A | 11/2016 |

(Continued)

*Primary Examiner* — Jose R Soto Lopez
(74) *Attorney, Agent, or Firm* — Cantor Colburn LLP

(57) ABSTRACT

A display device includes a display panel, a gate driving block which outputs a scan signal to the display panel, a source driving block which outputs a data signal to the display panel, and a controller. In the low-frequency mode, the controller divides the display panel into a first area operated at a first frequency lower than the reference frequency and a second area operated at a second frequency lower than the first frequency according to the image data, the source driving block outputs the data signal to the first area at the first frequency and outputs the data signal to the second area at the second frequency, and the gate driving block outputs a first scan signal to the first area at the first frequency and outputs a second scan signal to the second area at the second frequency.

15 Claims, 18 Drawing Sheets

(56) References Cited

U.S. PATENT DOCUMENTS

2006/0267901 A1* 11/2006 Maekawa ..... H02M 3/07 345/98
2007/0242314 A1* 10/2007 Santou ..... H04N 7/0122 358/443
2009/0146920 A1* 6/2009 Miyake ..... G09G 3/3677 345/55
2009/0315876 A1* 12/2009 Ichikawa ..... H04N 21/4316 345/213
2010/0253672 A1* 10/2010 Ota ..... G09G 3/3611 345/99
2011/0025662 A1* 2/2011 Huang ..... G09G 3/20 345/208
2011/0032231 A1* 2/2011 Maruyama ..... G09G 3/2096 345/208
2011/0261031 A1* 10/2011 Muto ..... G06F 3/04184 345/204
2012/0120048 A1* 5/2012 Nishimoto ..... G09G 3/20 345/212
2014/0320479 A1* 10/2014 Kaneko ..... G09G 3/3688 345/212
2015/0170607 A1* 6/2015 Shin ..... G09G 3/20 345/690
2015/0179120 A1* 6/2015 Nakagawa ..... G09G 3/3677 345/204
2015/0206488 A1* 7/2015 Zhang ..... G09G 3/3677 345/92
2015/0243203 A1* 8/2015 Kim ..... G09G 3/3291 345/212
2015/0243220 A1* 8/2015 Kim ..... H01L 27/1225 345/215
2016/0111055 A1* 4/2016 Na ..... G09G 3/3666 345/94
2016/0232831 A1* 8/2016 Nakanishi ..... G09G 3/3648
2016/0240565 A1* 8/2016 Kim ..... H01L 27/0922
2017/0025068 A1* 1/2017 Jeoung ..... G09G 3/3688
2017/0098431 A1* 4/2017 Oh ..... G09G 5/12
2017/0116946 A1* 4/2017 Nakatani ..... G09G 3/3677
2017/0150085 A1* 5/2017 Nishiguchi ..... G09G 3/3607
2018/0151140 A1* 5/2018 Wang ..... G09G 3/3677
2018/0308417 A1* 10/2018 Xie ..... G09G 3/3266
2019/0005904 A1* 1/2019 Mitsuzawa ..... G09G 3/3677
2019/0101755 A1* 4/2019 Weng ..... G02B 27/017
2019/0108802 A1* 4/2019 Imai ..... G09G 3/3685
2019/0206329 A1* 7/2019 Lee ..... G09G 3/3677
2019/0325835 A1* 10/2019 Ozaki ..... G09G 3/3677
2020/0098312 A1* 3/2020 Cho ..... G09G 3/3275
2020/0310566 A1* 10/2020 Chen ..... G06F 3/041
2021/0225227 A1* 7/2021 Li ..... G09G 3/20
2021/0342055 A1* 11/2021 Hirai ..... G09G 3/36

FOREIGN PATENT DOCUMENTS

KR 101773269 B1 8/2017
KR 101817597 B1 1/2018
KR 1020190083393 A 7/2019
KR 102072781 B1 2/2020

* cited by examiner

DISPLAY DEVICE

This application claims priority to Korean Patent Application No. 10-2020-0097623, filed on Aug. 4, 2020, and all the benefits accruing therefrom under 35 U.S.C. § 119, the content of which in its entirety is herein incorporated by reference.

BACKGROUND

1. Field

Embodiments of the invention relate to a display device. More particularly, embodiments of the invention relate to a display device capable of reducing a power consumption.

2. Description of the Related Art

Various types of display devices applied to multimedia devices, such as a television set, a mobile phone, a tablet computer, a navigation, etc., are being developed.

As fields of use of these display devices are diversified, types of images displayed through the display devices are also diversifying. In addition, different images are able to be displayed through one display device.

SUMMARY

Displaying an image through a display device consumes a lot of power, and as a driving frequency of the display device becomes high, the power consumption of the display device becomes high. Accordingly, a technology to reduce the power consumption of the display device is desired.

Embodiments of the invention provide a display device having reduced power consumption.

An embodiment of the invention provides a display device including a display panel which displays an image, a gate driving block which outputs a scan signal to the display panel, a source driving block which has a normal mode operated at a reference frequency and a low-frequency mode operated at a frequency lower than the reference frequency and outputs a data signal to the display panel, and a controller which receives image signals and an external control signal and generates a gate driving signal, a source driving signal, and image data in response to the image signals and the external control signal. The controller divides the display panel into a first area operated at a first frequency lower than the reference frequency and a second area operated at a second frequency lower than the first frequency according to the image data in the low-frequency mode. The source driving block outputs the data signal to the first area at the first frequency and outputs the data signal to the second area at the second frequency in the low-frequency mode. The gate driving block outputs a first scan signal to the first area at the first frequency and outputs a second scan signal to the second area at the second frequency in the low-frequency mode.

In an embodiment, the controller may include a driving controller that outputs a low-frequency control signal according to the normal mode operated at the reference frequency and the low-frequency mode operated at least one of the first frequency and the second frequency lower than the reference frequency in response to the image data.

In an embodiment, the controller may further include an area setting unit that divides the display panel into the first area and the second area in response to the low-frequency control signal and the image data and outputs a first control signal to drive the first area at the first frequency and a second control signal to drive the second area at the second frequency.

In an embodiment, the controller further may include a generator that generates a masking signal in response to the first and second control signals, and the controller may apply the gate driving signal and the masking signal to the gate driving block.

In an embodiment, the gate driving block may include a gate driver which generates a gate output signal in response to the gate driving signal and a masking unit which masks the gate output signal in response to the masking signal to output the scan signal.

In an embodiment, the gate driver may output the gate output signal at the reference frequency. The masking unit may mask the gate output signal corresponding to the first area to output the first scan signal at the first frequency and mask the gate output signal corresponding to the second area to output the second scan signal at the second frequency. The masking signal may include a first masking section in which the gate output signal corresponding to the first area is masked and a second masking section in which the gate output signal corresponding to the second area is masked.

In an embodiment, the gate driver may output the gate output signal at the first frequency in the low-frequency mode. The masking unit may not mask the gate output signal corresponding to the first area to output the first scan signal at the first frequency and masks the gate output signal corresponding to the second area to output the second scan signal at the second frequency. The masking signal may include a second masking section in which the gate output signal corresponding to the second area is masked.

In an embodiment, the controller may apply the image data, the source driving signal, and the first and second control signals to the source driving block. The source driving block may include a power controller which generates a power control signal in response to the first and second control signals and a source driver which converts the image data into the data signal in response to the power control signal and the source driving signal.

In an embodiment, the first frequency may be equal to or lower than about 1 Hertz (Hz).

In an embodiment, the second area may include at least two areas.

An embodiment of the invention provides a display device including a display panel which displays an image, a gate driving block which outputs a scan signal to the display panel, a source driving block which outputs a data signal to the display panel, and a controller which receives image signals and an external control signal and generates a gate driving signal, a source driving signal, and image data in response to the image signals and the external control signal. The controller divides the display panel into a reference area operated at a reference frequency and a low-frequency area operated at a frequency lower than the reference frequency according to the image data and divides the low-frequency area into a first area operated at a first frequency lower than the reference frequency and a second area operated at a second frequency lower than the first frequency according to the image data. The source driving block outputs the data signal to the reference area at the reference frequency, outputs the data signal to the first area at the first frequency, and outputs the data signal to the second area at the second frequency. The gate driving block outputs a reference scan signal to the reference area at the reference frequency, outputs a first scan signal to the first area at the first frequency, and outputs a second scan signal to the second area at the second frequency.

In an embodiment, the controller may include an area setting unit that divides the display panel into the reference area and the low-frequency area according to the image data, divide the low-frequency area into the first area and the second area, and output a reference control signal to drive the reference area at the reference frequency, a first control signal to drive the first area at the first frequency, and a second control signal to drive the second area at the second frequency.

In an embodiment, the controller may further include a generator that generates a masking signal in response to the reference control signal and the first and second control signals, and the controller may apply the gate driving signal and the masking signal to the gate driving block.

In an embodiment, the gate driving block may include a gate driver which generates a gate output signal in response to the gate driving signal and a masking unit which masks the gate output signal in response to the masking signal to output the scan signal.

In an embodiment, the gate driver may output the gate output signal at the reference frequency in the reference area and the first and second areas, the masking unit may not mask the gate output signal corresponding to the reference area to output the reference scan signal at the reference frequency, masks the gate output signal corresponding to the first area to output the first scan signal at the first frequency, and masks the gate output signal corresponding to the second area to output the second scan signal at the second frequency. The masking signal may include a first masking section in which the gate output signal corresponding to the first area is masked and a second masking section in which the gate output signal corresponding to the second area is masked.

In an embodiment, the first masking section may have a frequency different from a frequency of the second masking section.

In an embodiment, the controller may apply the image data, the source driving signal, the reference control signal, and the first and second control signals to the source driving block.

In an embodiment, the source driving block may include a power controller which generates a power control signal in response to the reference control signal and the first and second control signals and a source driver which converts the image data into the data signal in response to the power control signal and the source driving signal.

In an embodiment, the reference frequency may be equal to or lower than about 1 Hz.

In an embodiment, the second area may include at least two areas.

According to the above, the display panel is divided into areas according to the images displayed therein, and the areas are operated at different frequencies from each other. Thus, the power consumption of the display device is reduced.

BRIEF DESCRIPTION OF THE DRAWINGS

The above and other advantages of the invention will become readily apparent by reference to the following detailed description when considered in conjunction with the accompanying drawings in which.

DETAILED DESCRIPTION

Figure 1:
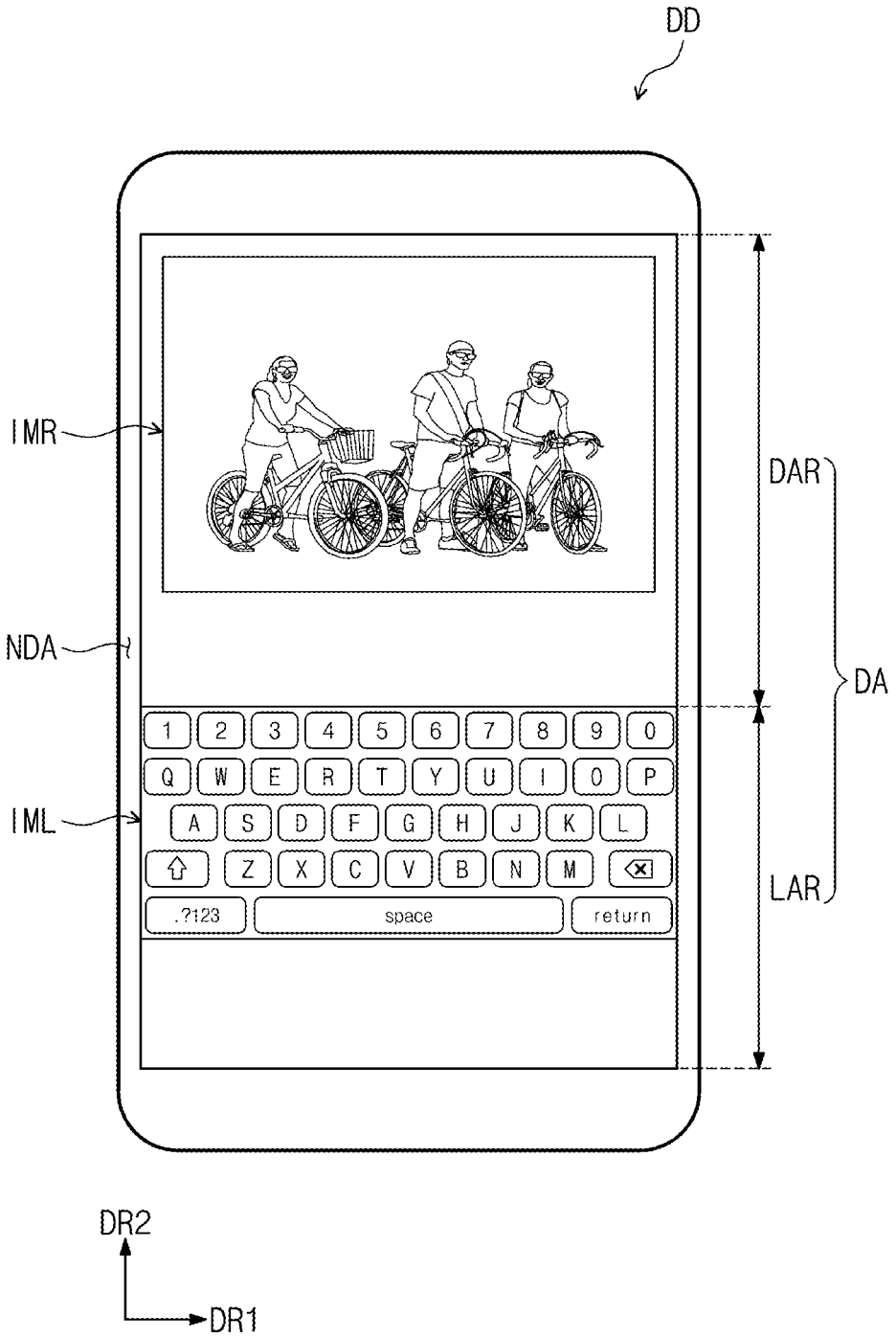
FIG. 1 is a plan view showing an embodiment of a display device according to the invention.

In the disclosure, it will be understood that when an element or layer is referred to as being "on", "connected to" or "coupled to" another element or layer, it can be directly on, connected or coupled to the other element or layer or intervening elements or layers may be present.

Like numerals refer to like elements throughout. In the drawings, the thickness, ratio, and dimension of components are exaggerated for effective description of the technical content.

As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element or feature as illustrated in the drawing figures.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Terms such as "unit" or "block" may refer to a circuit or a processor, for example.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof Hereinafter, the invention will be explained in detail with reference to the accompanying drawings.

FIG. 1 is a plan view showing an embodiment of a display device DD according to the invention.

Referring to FIG. 1, a mobile terminal is shows as a representative embodiment of the display device DD. The mobile terminal may include a tablet personal computer ("PC"), a smartphone, a personal digital assistant, a portable multimedia player, a game unit, a wrist watch type electronic device, etc., however, the invention should not be limited thereto or thereby. The display device according to the invention may be applied to a large-sized electronic item, such as a television set, an outdoor billboard, etc., and a small and medium-sized electronic item, such as a personal computer, a notebook computer, a kiosk, a car navigation unit, a camera, etc. However, this is merely exemplary, and the display device may be applied to other electronic devices as long as they do not depart from the inventive concept of the disclosure.

Referring to FIG. 1, a display surface through which a reference image IMR and a low-frequency image IML are displayed is substantially parallel to a plane defined by a first direction DR1 and a second direction DR2. The display device DD includes a plurality of areas distinguished from each other on the display surface. The display surface includes a display area DA through which an image is displayed and a non-display area NDA adjacent to the display area DA. The non-display area NDA may be also referred to as a "bezel area". In an embodiment, the display area DA may have a quadrangular shape. The non-display area NDA may surround the display area DA. In addition, although not shown in drawing figures, the display device DD may have a shape that is partially curved. As a result, a portion of the display area DA may have a curved shape.

The display area DA of the display device DD includes a reference area DAR and a low-frequency area LAR. In a predetermined application program, the reference image IMR is displayed through the reference area DAR, and the low-frequency image IML is displayed through the low-frequency area LAR. In an embodiment, the reference image IMR may be a video, however, it should not be particularly limited. The low-frequency image IML may be a still image, such as a keypad, or an image including text information with a long change cycle, however, it should not be particularly limited.

The display device DD in the embodiment may drive the reference area DAR at a reference frequency RF (refer to FIG. 7A) and may drive the low-frequency area LAR at a frequency lower than the reference frequency RF. The display device DD may lower the driving frequency of the low-frequency area LAR, and thus, a power consumption may be reduced.

Each of the reference area DAR and the low-frequency area LAR may have a predetermined size, and the size may be changed by an application program. In an embodiment, the display area DA may include only the reference area DAR through which the reference image IMR is displayed or may include only the low-frequency area LAR through which the low-frequency image IML is displayed. In addition, the low-frequency area LAR may be divided into two or more areas, and the driving frequency of each of the areas may be determined depending on the type or grayscale of image displayed through each area.

Figure 2:
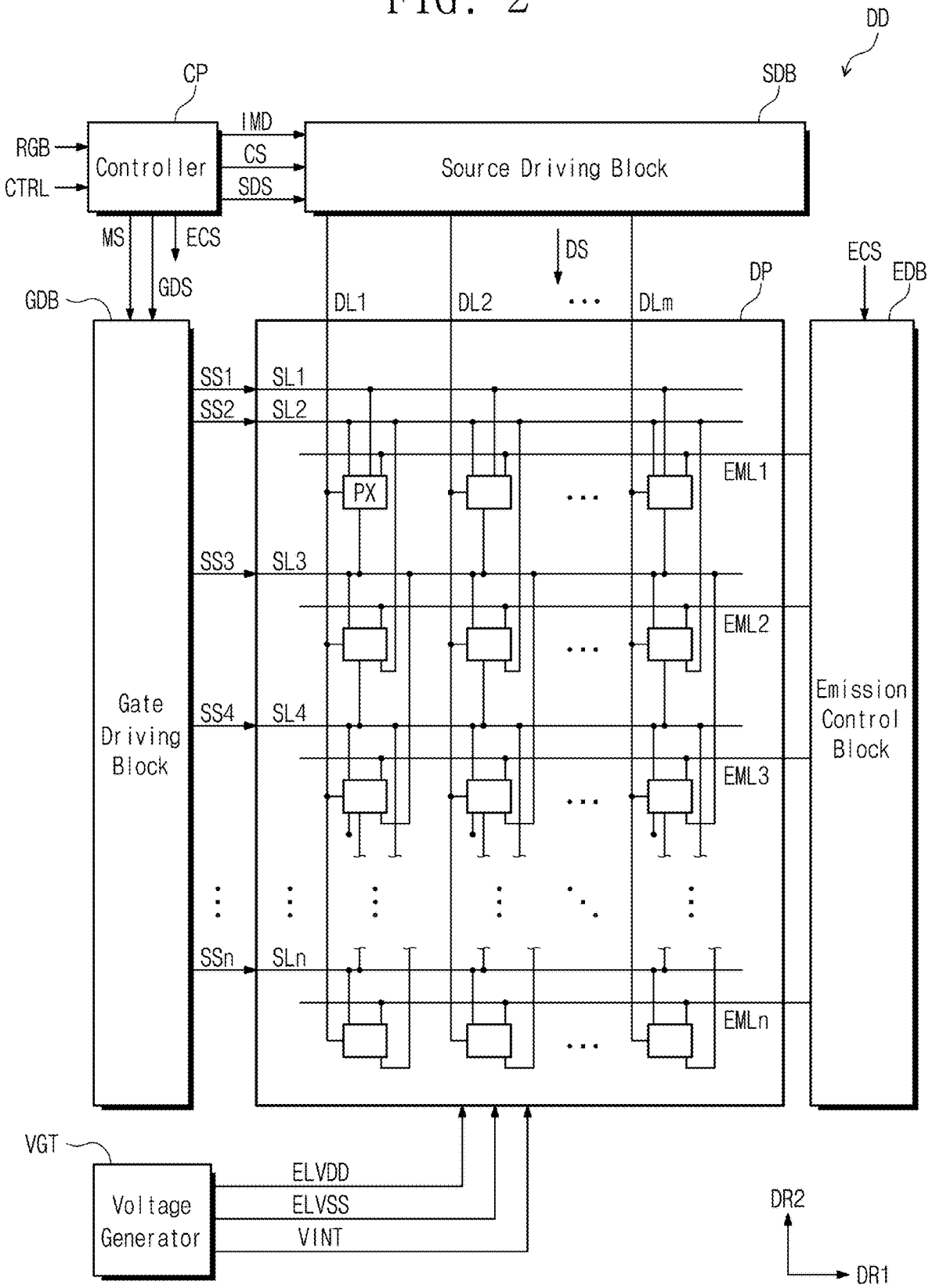
FIG. 2 is a block diagram showing an embodiment of a display device according to the invention.
Figure 3:
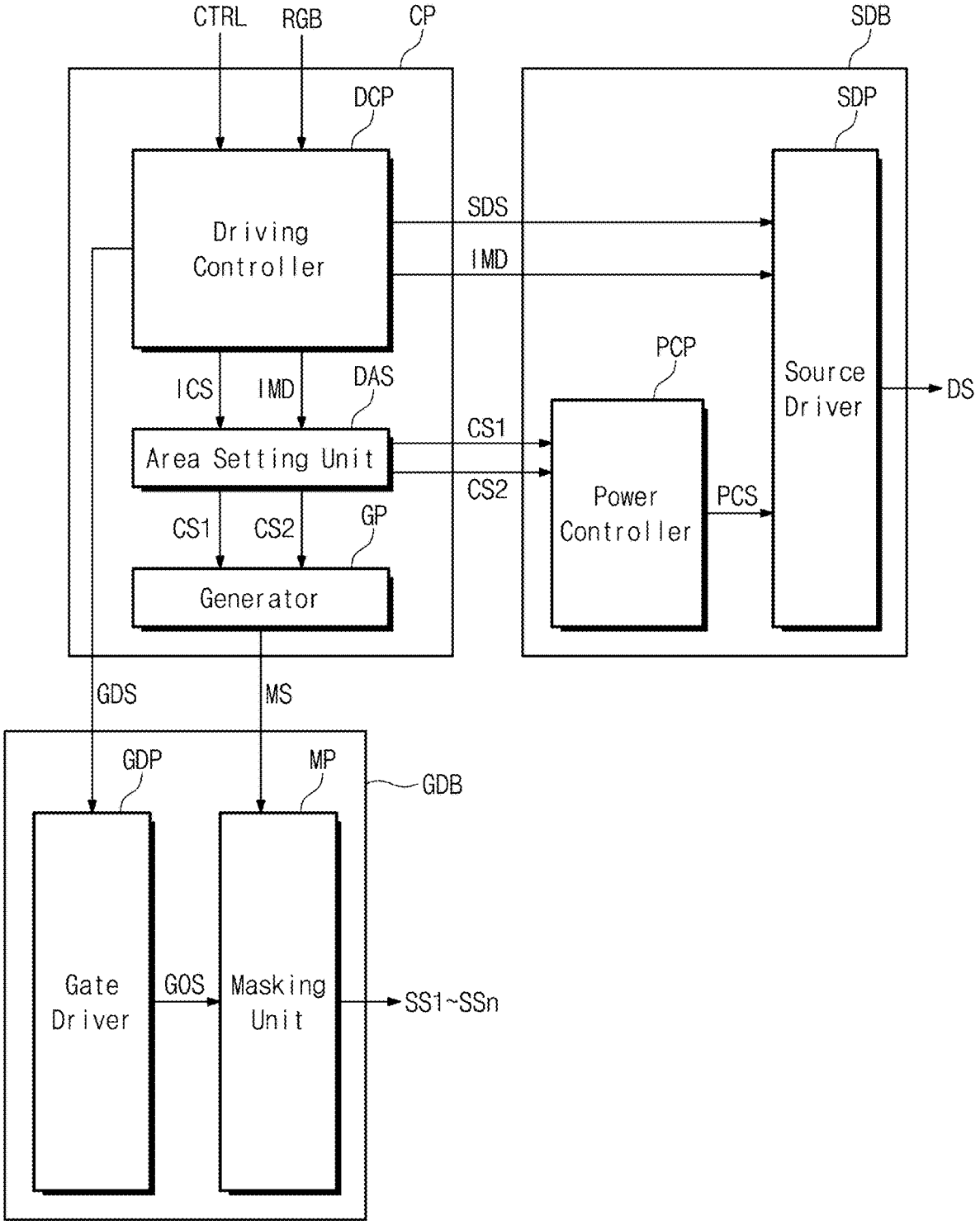
FIG. 3 is a block diagram showing an embodiment of a controller, a gate driving block, and a source driving block according to the invention.
Figure 4A:
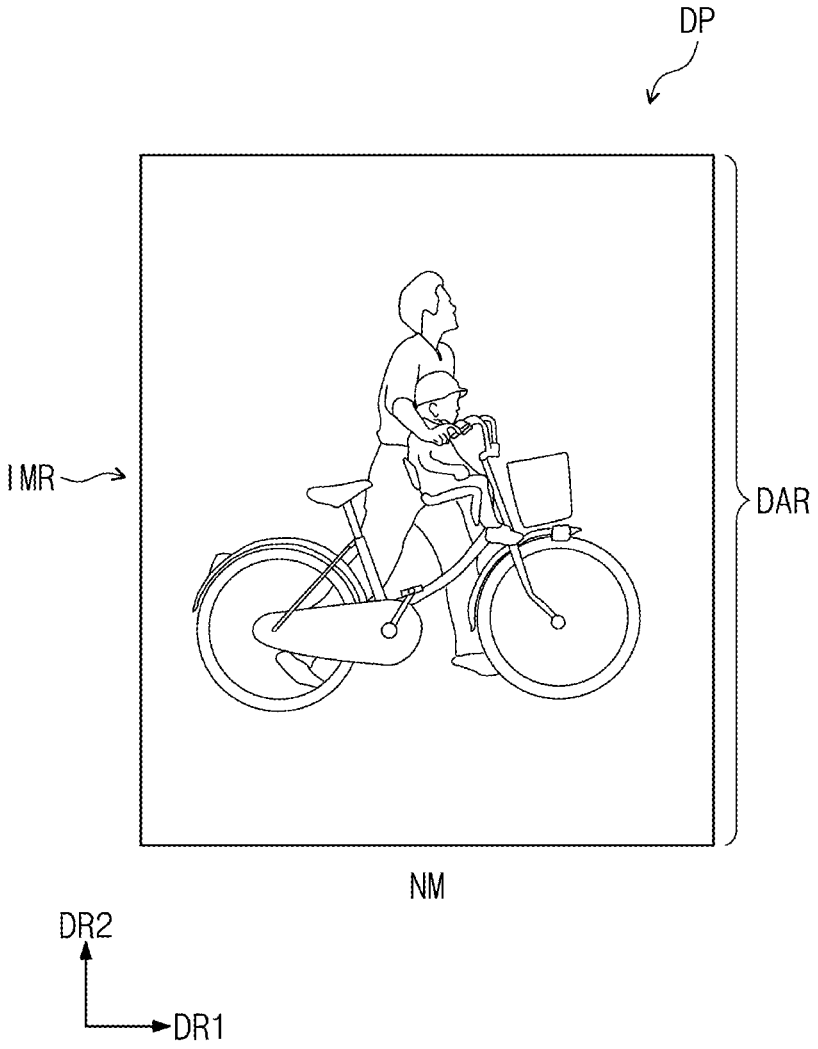
FIG. 4A is a plan view showing an embodiment of a display panel according to the invention.
Figure 4B:
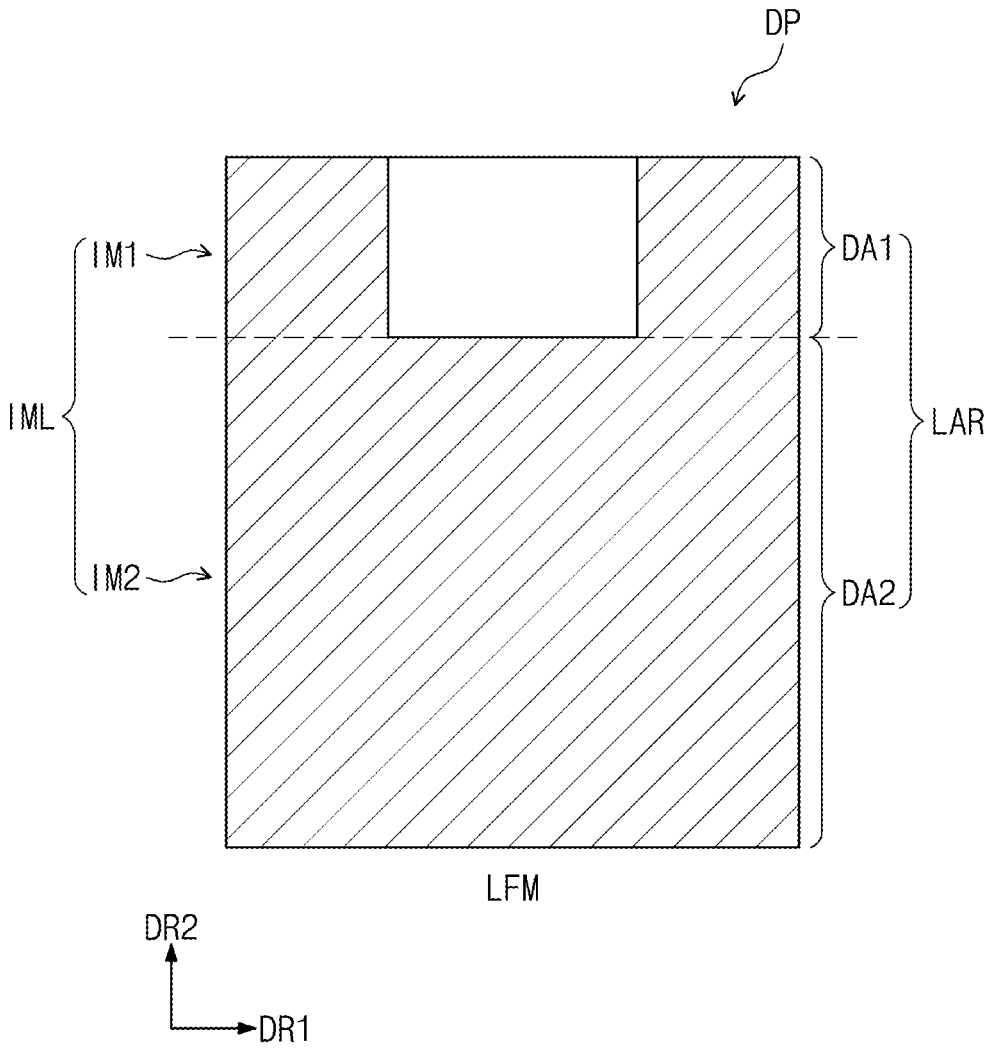
FIG. 4B is a plan view showing an embodiment of a display panel according to the invention.
Figure 4C:
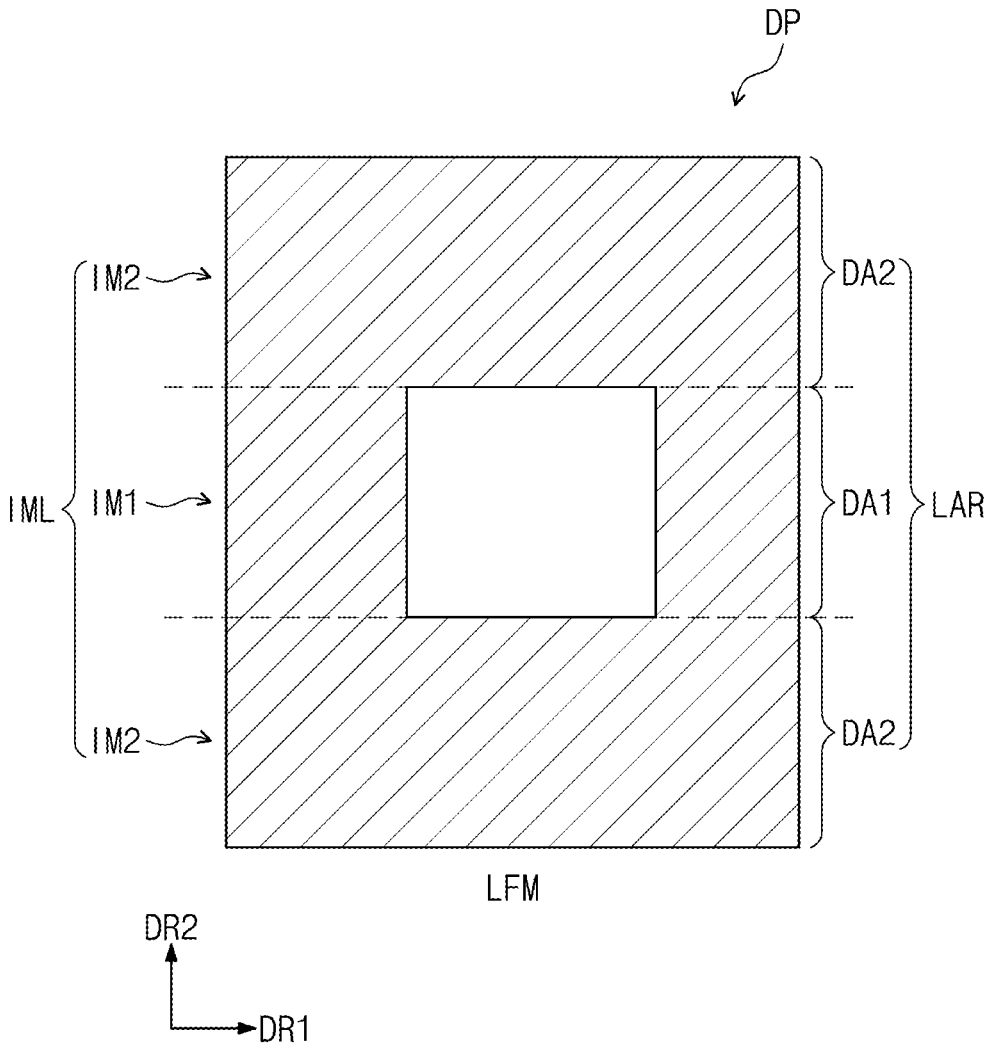
FIG. 4C is a plan view showing an embodiment of a display panel according to the invention.

FIG. 2 is a block diagram showing an embodiment of the display device according to the invention. FIG. 3 is a block diagram showing an embodiment of a controller CP, a gate driving block GDB, and a source driving block SDB according to the invention. FIGS. 4A to 4C are plan views showing an embodiment of display panels according to the invention.

Referring to FIGS. 2 and 3, the display device DD includes a display panel DP, the controller CP, the source driving block SDB, the gate driving block GDB, an emission control block EDB, and a voltage generator VGT.

The controller CP receives image signals RGB and an external control signal CTRL from an external source. The controller CP converts a data format of the image signals RGB into a data format appropriate to an interface between the controller CP and the source driving block SDB to generate image data IMD. The controller CP generates a source driving signal SDS, a gate driving signal GDS, control signals CS, a masking signal MS, and an emission control signal ECS based on the external control signal CTRL. The controller CP provides the image data IMD, the source driving signal SDS, and the control signals CS to the source driving block SDB. The controller CP provides the gate driving signal GDS and the masking signal MS to the gate driving block GDB, and provides the emission control signal ECS to the emission control block EDB.

The source driving block SDB converts the image data IMD into data signals DS in response to the source driving signal SDS and the control signals CS and outputs the data signals DS to a plurality of data lines DL1 to DLm (m is a natural number) described later. The data signals DS are analog voltages corresponding to grayscale values of the image data IMD.

The gate driving block GDB receives the gate driving signal GDS and the masking signal MS from the controller CP. The gate driving block GDB generates a gate output signal GOS based on the gate driving signal GDS. In addition, the gate driving block GDB masks the gate output signal GOS in response to the masking signal MS to generate scan signals SS1 to SSn and outputs the scan signals SS1 to SSn (n is a natural number) to a plurality of scan lines SL1 to SLn.

The emission control block EDB receives the emission control signal ECS from the controller CP. The emission control block EDB outputs emission signals to emission lines EML1 to EMLn in response to the emission control signal ECS.

The voltage generator VGT generates voltages desired for an operation of the display panel DP. In an embodiment of the invention, the voltage generator VGT generates a first driving voltage ELVDD, a second driving voltage ELVSS, and an initialization voltage VINT. In an embodiment of the invention, the voltage generator VGT may be operated in response to a control by the controller CP.

The display panel DP includes the scan lines SL1 to SLn, the data lines DL1 to DLm, the emission lines EML1 to EMLn, and the pixels PX. The scan lines SL1 to SLn extend in the first direction DR1 from the gate driving block GDB and are arranged in the second direction DR2 to be spaced apart from each other. The data lines DL1 to DLm extend in a direction opposite to the second direction DR2 from the source driving block SDB and are arranged in the first direction DR1 to be spaced apart from each other.

Each of the pixels PX is electrically connected to corresponding three scan lines among the scan lines SL1 to SLn. In addition, each of the pixels PX is electrically connected to a corresponding emission line among the emission lines EML1 to EMLn and a corresponding data line among the data lines DL1 to DLm. In an embodiment, as shown in FIG. 2, a first pixel among the pixels PX is connected to first, second, and third scan lines SL1, SL2, and SL3, a first emission line EML1, and a first data line DL1, for example.

Each of the pixels PX includes an organic light emitting diode and a pixel circuit that controls an emission of the organic light emitting diode. The pixel circuit includes a plurality of transistors and a capacitor. Each of the pixels PX receives the first driving voltage ELVDD, the second driving voltage ELVSS, and the initialization voltage VINT.

Referring to FIGS. 3 to 4C, the controller CP includes a driving controller DCP, an area setting unit DAS, and a generator GP.

The driving controller DCP receives the image signals RGB and the external control signal CTRL from the external source. The driving controller DCP generates the gate driving signal GDS and the source driving signal SDS from the external control signal CTRL to respectively control the gate driving block GDB and the source driving block SDB.

The gate driving signal GDS used to control the gate driving block GDB includes a vertical start signal and a scan clock signal. The source driving signal SDS used to control the source driving block SDB includes a horizontal start signal and a data clock signal.

The driving controller DCP converts the data format of the image signals RGB into the data format appropriate to the interface between the driving controller DCP and the source driving block SDB and generates the image data IMD.

The driving controller DCP generates a low-frequency control signal ICS based on the image data IMD to allow the display device DD (refer to FIG. 2) to operate in a normal mode NM in which the display device DD operates at the reference frequency RF (refer to FIG. 7A) and to operate in a low-frequency mode LFM in which the display device DD operates at frequencies RF1 and RF2 (refer to FIG. 7B) equal to or lower than the reference frequency RF.

The area setting unit DAS receives the image data IMD and the low-frequency control signal ICS from the driving controller DCP. The area setting unit DAS may be turned on or off in response to the low-frequency control signal ICS. In detail, the low-frequency control signal ICS is deactivated in the normal mode NM and activated in the low-frequency mode LFM. That is, the area setting unit DAS may be turned off in response to the low-frequency control signal ICS deactivated in the normal mode NM and may be turned on in response to the low-frequency control signal ICS activated in the low-frequency mode LFM. In the low-frequency mode LFM, the area setting unit DAS may divide the low-frequency area LAR into a first area DA1 in which a first image IM1 is displayed at a first frequency RF1 lower than the reference frequency RF and a second area DA2 in which a second image IM2 is displayed at a second frequency RF2 lower than the first frequency RF1. In this case, the first frequency RF1 may be set as one of frequencies in a frequency range where a deterioration in display quality due to flickering does not occur when the first image IM1 is displayed in the first area DA1. In addition, the second frequency RF2 may be set as one of frequencies in the frequency range where a deterioration in display quality due to flickering does not occur when the second image IM2 is displayed in the second area DA2. In this case, the frequencies (e.g., the reference frequency RF, the first frequency RF1, and the second frequency RF2) set in each area may be varied depending on properties of transistors included in the pixels PX (refer to FIG. 2). In an embodiment of the invention, when the transistors included in the pixels PX are provided by a low-temperature polycrystalline silicon ("LTPS") process, images including patterns with high grayscale are desired to operate at a relatively higher frequency than that of images including patterns with low grayscale, however, they should not be limited thereto or thereby. In another embodiment, the images including the patterns with low grayscale may be desired to operate at the relatively higher frequency than that of the images including the patterns with high grayscale as needed.

The area setting unit DAS generates the control signals CS (refer to FIG. 2) based on information on the first and second areas DA1 and DA2. In an embodiment of the invention, the control signals CS include a first control signal CS1 and a second control signal CS2. The first control signal CS1 is a signal that drives the first area DA1 at the first frequency RF1 lower than the reference frequency RF, and the second control signal CS2 is a signal that drives the second area DA2 at the second frequency RF2 lower than the first frequency RF1.

FIGS. 3 and 4B show a structure that the area setting unit DAS divides the display panel DP into the first area DA1 and the second area DA2, however, the invention should not be limited thereto or thereby. In the low-frequency mode LFM, the area setting unit DAS may divide the display panel DP into the first area DA1, the second area DA2, and a third area (not shown). In this case, the area setting unit DAS generates a third control signal that drives the third area at a third frequency lower than the second frequency RF2. When the display panel DP is divided into the first, second, and third areas, two or more areas may be driven at the same frequency. In an embodiment, the second area DA2 driven at the second frequency RF2 may include two or more areas in the display panel DP, and the two or more areas are spaced apart from each other in the first direction DR1 (refer to FIG. 2), for example. In an embodiment, the first frequency RF1 may be about 1 Hertz (Hz), and the second frequency RF2 may be an ultra-low frequency lower than about 1 Hz, for example.

In FIG. 3, the driving controller DCP and the area setting unit DAS are provided separately from each other, however, they should not be limited thereto or thereby. In an embodiment, the area setting unit DAS may be included in the driving controller DCP. In this case, the driving controller DCP generates the low-frequency control signal ICS, the first and second control signals CS1 and CS2. The generator GP receives the first control signal CS1 and the second control signal CS2. The generator GP generates and outputs the masking signal MS based on the first control signal CS1 and the second control signal CS2. The masking signal MS is a signal that controls a frequency of the scan signals SS1 to SSn generated by the gate driving block GDB. The masking signal MS is applied to a masking unit MP in the gate driving block GDB. The masking signal MS is commonly applied to masking circuits MC1 to MCn (refer to FIG. 5) of the masking unit MP.

The gate driving block GDB includes a gate driver GDP and the masking unit MP.

The gate driver GDP receives the gate driving signal GDS from the controller CP. The gate driver GDP generates and outputs the gate output signal GOS in response to the gate driving signal GDS.

The masking unit MP receives the masking signal MS from the controller CP and receives the gate output signal GOS from the gate driver GDP. The masking unit MP masks the gate output signal GOS in response to the masking signal MS to generate and output the scan signals SS1 to SSn.

The source driving block SDB includes a power controller PCP and a source driver SDP.

The power controller PCP receives the first and second control signals CS1 and CS2 from the area setting unit DAS. The power controller PCP generates and outputs a power control signal PCS in response to the first and second control signals CS1 and CS2.

The source driver SDP receives the source driving signal SDS and the image data IMD from the driving controller DCP and receives the power control signal PCS from the power controller PCP. The source driver SDP converts the image data IMD into the data signals DS in response to the power control signal PCS and the source driving signal SDS. The source driver SDP determines whether to apply the data signals DS to the display panel DP in response to the power control signal PCS. In detail, when power control signal PCS is activated, the source driver SDP may not apply the data signals DS to the display panel DP for several frames. In addition, the power consumption of the display device DD may decrease by lowering a driving voltage or a driving current that drives the source driver SDP while the data signals DS are not applied to the display panel DP.

Figure 7A:
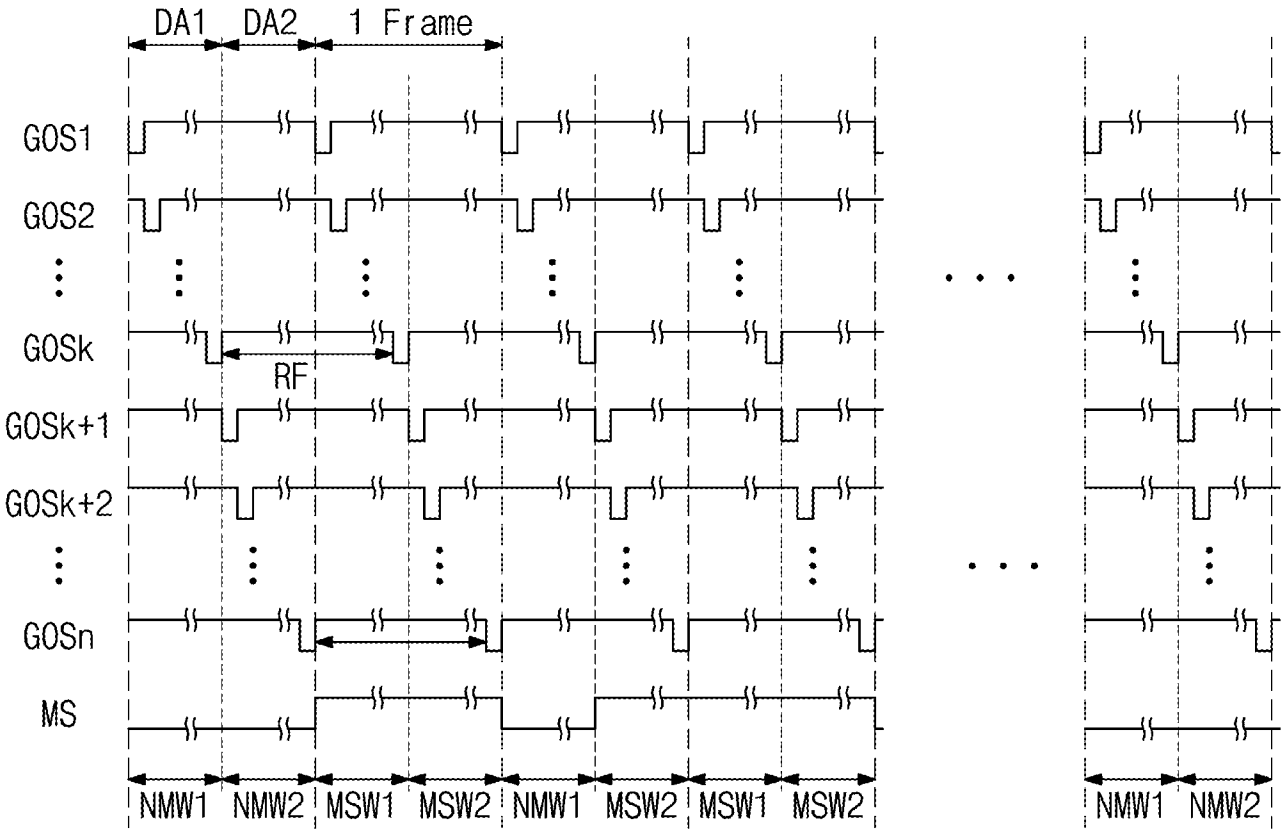
FIG. 7A is a timing diagram showing an embodiment of an operation of a gate driving block according to the invention.

Referring to FIGS. 1, 3, and 4A, when the reference image IMR is displayed through the display panel DP, the reference area DAR through which the reference image IMR is displayed may be driven at the reference frequency RF (refer to FIG. 7A). When the entire display area DA is driven at the reference frequency RF, the display device DD operates in the normal mode NM. In the normal mode NM, the driving controller DCP outputs the low-frequency control signal ICS that is not activated.

Referring to FIGS. 1, 3, and 4B, when the low-frequency image IML is displayed through the display panel DP, the low-frequency area LAR through which the low-frequency image IML is displayed may be driven at a frequency lower than the reference frequency RF. The low-frequency image IML may include the first image IM1 having a predetermined grayscale pattern and the second image IM2 that does not have the predetermined grayscale pattern. In an embodiment of the invention, the first image IM1 including the predetermined grayscale pattern may be an image desired to be driven at a high frequency so that the first image IM1 is displayed without flickering. The display device DD may drive the first area DA1 through which the first image IM1 is displayed at the first frequency RF1 (refer to FIG. 7B) and may drive the second area DA2 through which the second image IM2 is displayed at the second frequency RF2 (refer to FIG. 7B). The second frequency RF2 may have a frequency lower than the first frequency RF1. The first image IM1 may be displayed without interruption or flickering even though the first area DA1 is driven at the first frequency RF1 that is lower than reference frequency RF. The second image IM2 may be displayed without interruption or flickering even though the second area DA2 is driven at the second frequency RF2 that is lower than first frequency RF1. When at least one of the first and second areas DA1 and DA2 driven at the first and second frequencies RF1 and RF2 lower than the reference frequency RF is in display panel DP, the display device DD may be operated in the low-frequency mode LFM. In the low-frequency mode LFM, the driving controller DCP outputs the low-frequency control signal ICS that is activated.

Referring to FIGS. 1, 3, and 4C, the display panel DP may include the first area DA1 and the plural second areas DA2. In an embodiment of the invention, the second areas DA2 may include two or more second areas DA2 spaced apart from each other in the second direction DR2 with the first area DA1 interposed therebetween in the display panel DP. However, the invention should not be limited thereto or thereby. The first area DA1 may be provided in plural in the display panel DP. In an embodiment, the display panel DP may further include the third area through which the third image is displayed. The third area may be driven at the third frequency different from the first and second frequencies RF1 and RF2. In an embodiment of the invention, the third image may be displayed without interruption or flickering even though the third area is driven at a frequency lower than the second frequency RF2.

Figure 5:
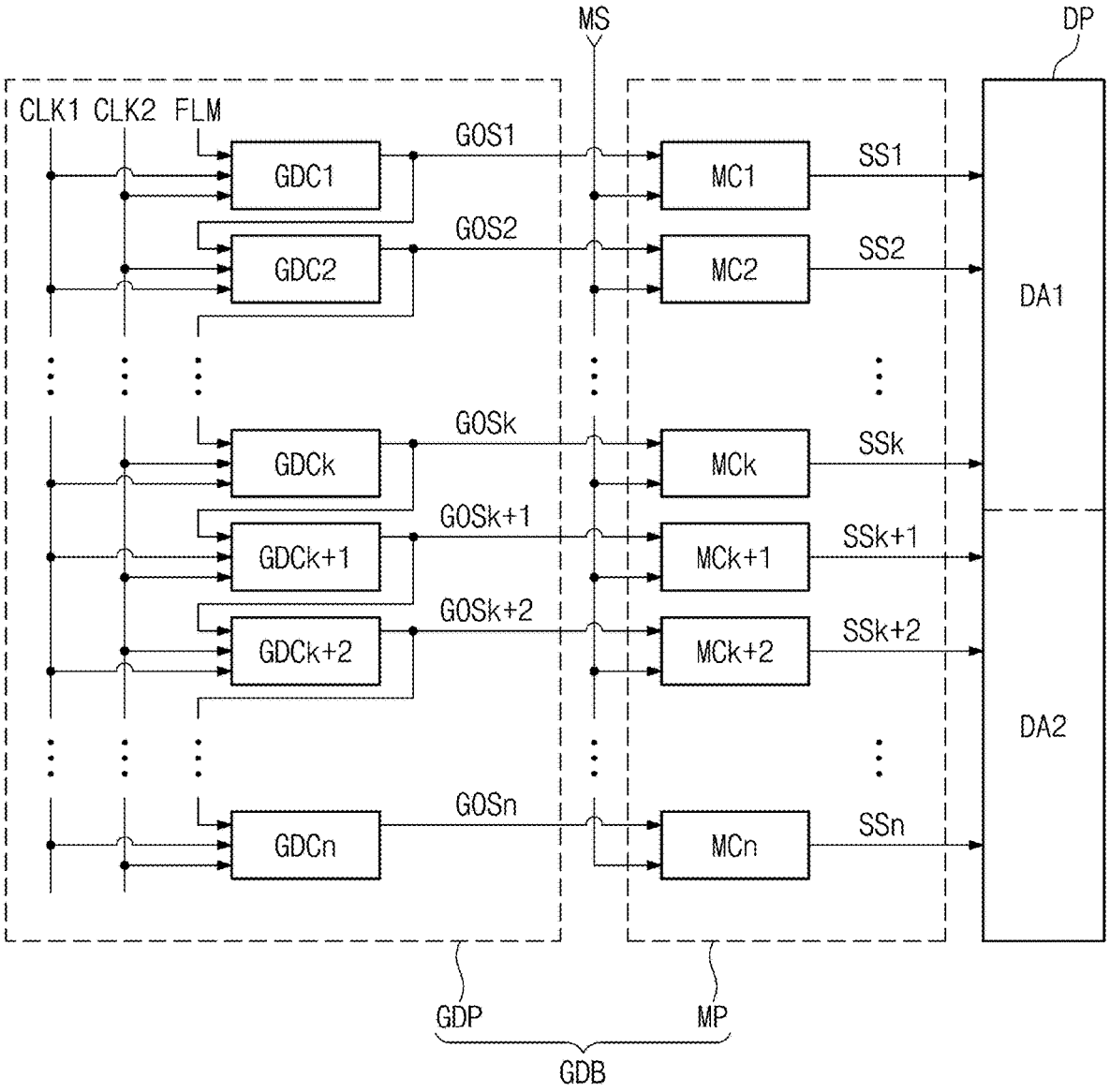
FIG. 5 is a block diagram showing an embodiment of a gate driving block according to the invention.
Figure 6:
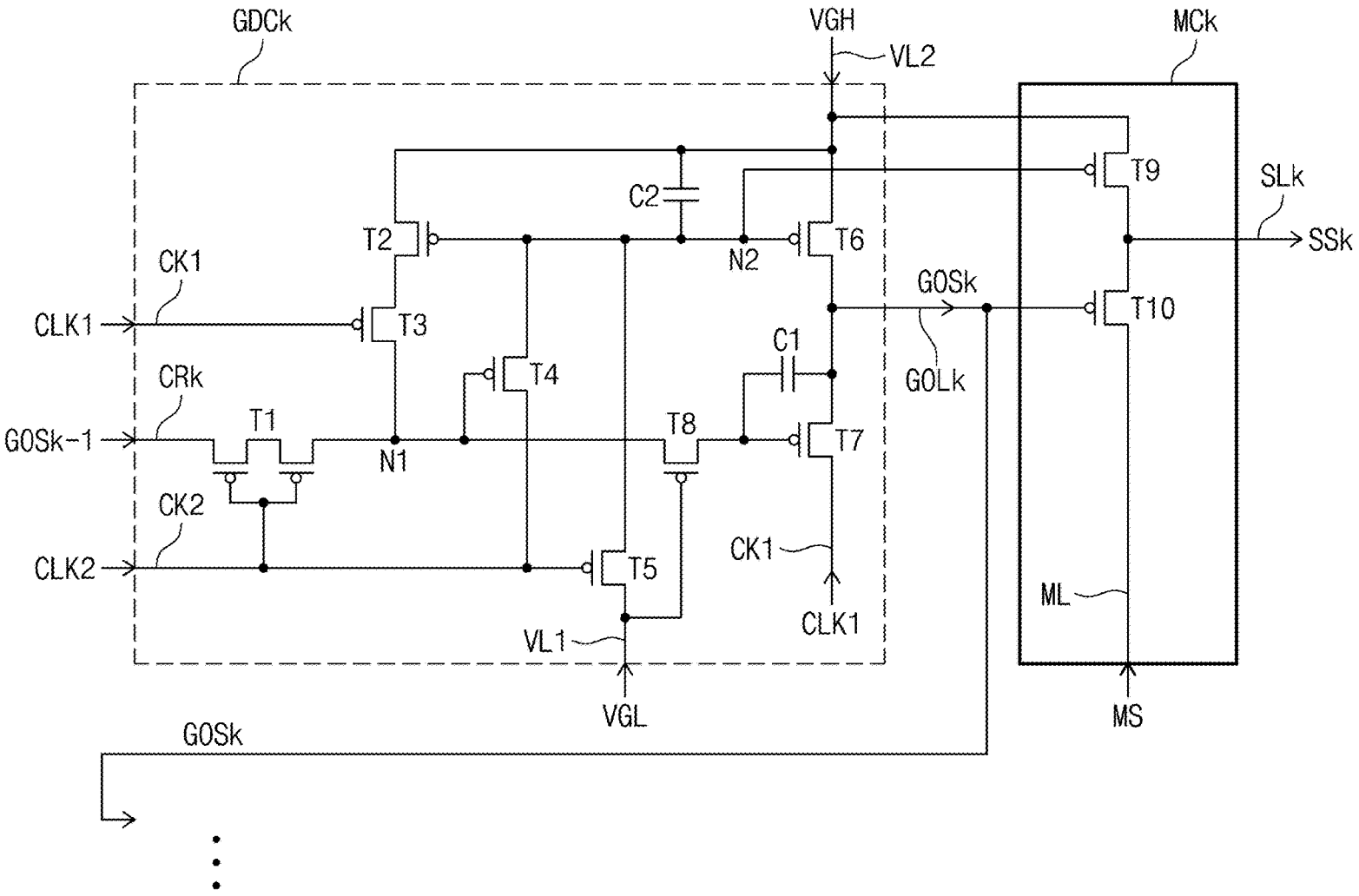
FIG. 6 is a circuit diagram showing an embodiment of a k-th gate driving circuit and a k-th masking circuit according to the invention.
Figure 7B:
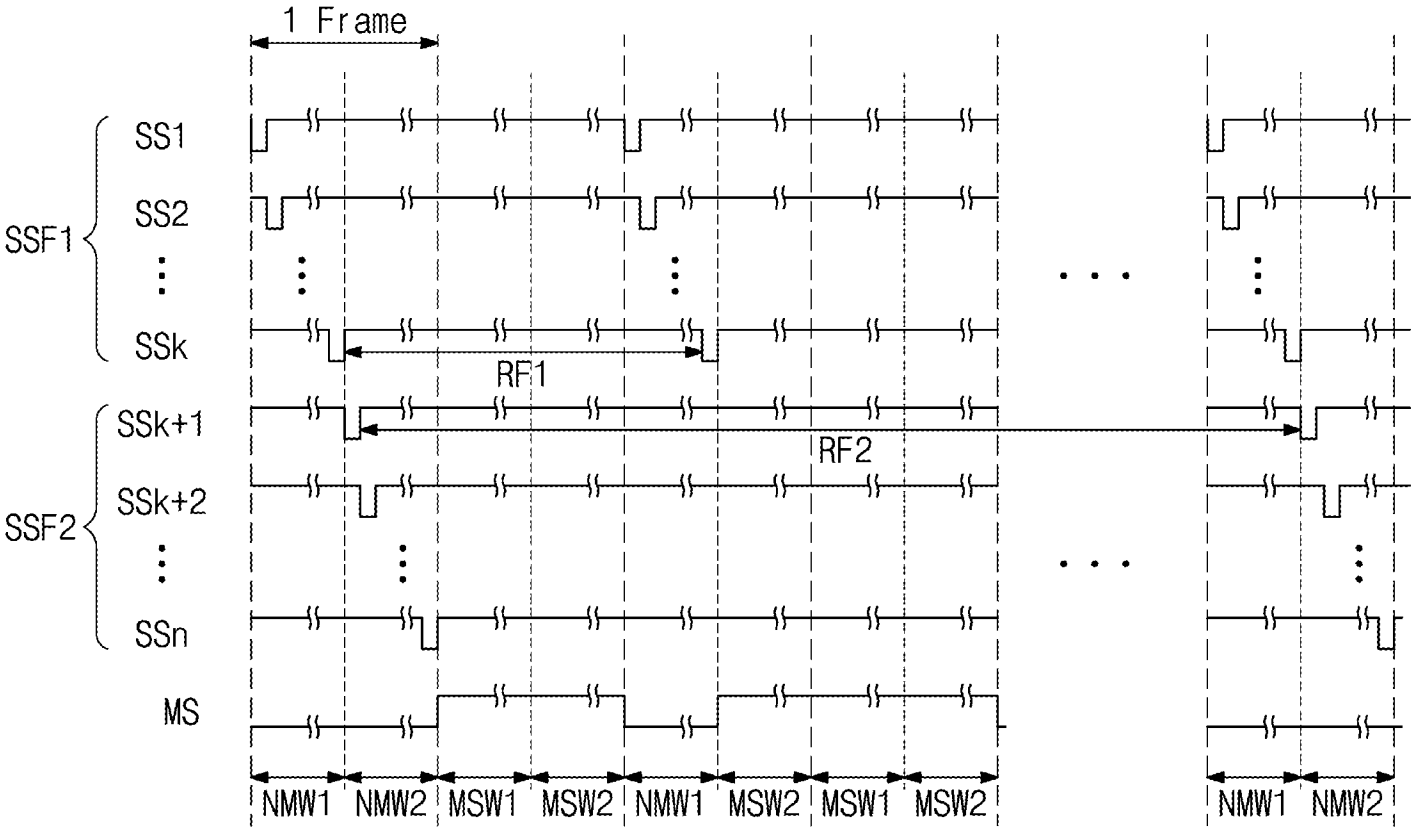
FIG. 7B is a timing diagram showing an output of scan signals according to the operation of the gate driving block of FIG. 7A.

FIG. 5 is a block diagram showing an embodiment of the gate driving block GDB in an embodiment of the invention, and FIG. 6 is a circuit diagram showing an embodiment of a k-th gate driving circuit and a k-th masking circuit according to the invention. FIG. 7A is a timing diagram showing an embodiment of an operation of the gate driving block GDB according to the invention, and FIG. 7B is a timing diagram showing an output of the scan signals according to the operation of the gate driving block GDB of FIG. 7A.

Referring to FIGS. 3 and 5, the gate driving block GDB includes the gate driver GDP and the masking unit MP. The gate driver GDP includes a shift register in which stages GDC1 to GDCn are connected one after another. The gate driver GDP receives the gate driving signal GDS from the driving controller DCP. In an embodiment of the invention, the gate driving signal GDS includes a first clock signal CLK1, a second clock signal CLK2, and a vertical start signal FLM. The number of clock signals included in the gate driving signal GDS should not be limited thereto or thereby. Each of the stages GDC1 to GDCn further receives a first voltage VGL (refer to FIG. 6) and a second voltage VGH (refer to FIG. 6).

The stages GDC1 to GDCn in the embodiment output the gate output signals GOS1 to GOSn, respectively. The masking unit MP includes the masking circuits MC1 to MCn respectively connected to the stages GDC1 to GDCn. The gate output signals GOS1 to GOSn that are respectively output from the stages GDC1 to GDCn are provided to the masking circuits MC1 to MCn, respectively. Hereinafter, for convenience of description, the stages GDC1 to GDCn are also referred to as gate driving circuits GDC1 to GDCn.

The gate driving circuits GDC1 to GDCn are connected one after another, and each of the gate driving circuits GDC1 to GDCn receives the gate output signal output from a previous gate driving circuit as a carry signal. Among the gate driving circuits GDC1 to GDCn, a first gate driving circuit GDC1 receives the vertical start signal FLM as the carry signal. A k-th gate output signal GOSk (k is a natural number less than n) output from a k-th gate driving circuit GDCk among the gate driving circuits GDC1 to GDCn is provided as a carry signal of a (k+1)th gate driving circuit GDCk+1.

Referring to FIGS. 5, 7A, and 7B, the masking circuits MC1 to MCn receive the masking signal MS from the generator GP (refer to FIG. 3). The masking signal MS is commonly applied to the masking circuits MC1 to MCn. The masking circuits MC1 to MCn receive the gate output signals GOS1 to GOSn from the gate driver GDP, respectively.

Among the masking circuits MC1 to MCn, a k-th masking circuit MCk receives the k-th gate output signal GOSk output from the k-th gate driving circuit GDCk and the masking signal MS from the controller CP. The k-th masking circuit MCk masks the k-th gate output signal GOSk in response to the masking signal MS and outputs a k-th scan signal SSk.

The masking signal MS controls a frequency of the scan signals SS1 to SSn generated by the gate driving block GDB. In detail, the masking unit MP masks the gate output signals GOS1 to GOSn output from the gate driver GDP in response to the masking signal MS to control the frequency of the scan signals SS1 to SSn. When the gate driver GDP outputs the gate output signals GOS1 to GOSn having the reference frequency RF, the masking unit MP masks the gate output signals GOS1 to GOSk corresponding to the first area DA1 of the display panel DP and outputs a first group scan signal SSF1 including the scan signals SS1 to SSk having the first frequency RF1. In addition, the masking unit MP masks the gate output signals GOSk+1 to GOSn corresponding to the second area DA2 of the display panel DP and outputs a second group scan signal SSF2 including the scan signals SSk+1 to SSn having the second frequency RF2. The masking signal MS includes a first masking section MSW1 that masks the gate output signals GOS1 to GOSk corresponding to the first area DA1 and a second masking section MSW2 that masks the gate output signals GOSk+1 to GOSn corresponding to the second area DA2.

Referring to FIGS. 6, 7A, and 7B, the k-th gate driving circuit GDCk includes a first clock line CK1, a second clock line CK2, a k-th carry line CRk, a first voltage line VL1, a second voltage line VL2, and a k-th gate output line GOLk. The first clock line CK1 receives the first clock signal CLK1, and the second clock line CK2 receives the second clock signal CLK2. The k-th carry line CRk receives a (k−1)th gate output signal GOSk−1. The first voltage line VL1 receives the first voltage VGL, and the second voltage line VL2 receives the second voltage VGH. The first clock signal CLK1 and the second clock signal CLK2 have the reference frequency RF and have opposite phases to each other.

For the convenience of explanation, in descriptions with reference to FIG. 6, the k-th carry line CRk is also referred to as a "carry line CRk", and the k-th gate output line GOLk is also referred to as a "gate output line GOLk".

In the illustrated embodiment, the k-th gate driving circuit GDCk includes first, second, third, fourth, fifth, sixth, seventh, and eighth transistors T1, T2, T3, T4, T5, T6, T7 and T8 and first and second capacitors C1 and C2. In addition, the k-th masking circuit MCk includes ninth and tenth transistors T9 and T10. In the illustrated embodiment, each of the first to tenth transistors T1 to T10 will be described as a p-type transistor. However, the invention should not be limited thereto or thereby, and each of the first to tenth transistors T1 to T10 may be implemented as the p-type transistor or an n-type transistor. In another embodiment, some transistors among the first to tenth transistors T1 to T10 may be implemented as the p-type transistor, and the other transistors may be implemented as the n-type transistor. In addition, the number of transistors included in the k-th gate driving circuit GDCk and the k-th masking circuit MCk should not be limited thereto or thereby. That is, at least one of the first to tenth transistors T1 to T10 may be omitted, and in another embodiment, one or more transistors may be added.

The first transistor T1 includes a first electrode connected to the carry line CRk, a second electrode electrically connected to a first node N1, and a gate electrode connected to the second clock line CK2. The first transistor T1 applies the (k−1)th gate output signal GOSk−1 provided through the carry line CRk to the first node N1 in response to the second clock signal CLK2.

The second transistor T2 includes a first electrode connected to the second voltage line VL2, a second electrode electrically connected to the first node N1 via the third transistor T3, and a gate electrode connected to a second node N2. The second transistor T2 applies the second voltage VGH to a first electrode of the third transistor T3 according to an electric potential of the second node N2.

The third transistor T3 is connected between the second transistor T2 and the first node N1. In particular, the third transistor T3 includes the first electrode connected to the second transistor T2, a second electrode electrically connected to the first node N1, and a gate electrode connected to the first clock line CK1. The third transistor T3 applies the second voltage VGH provided through the second transistor T2 to the first node N1 in response to the first clock signal CLK1.

The fourth transistor T4 includes a first electrode connected to the second clock line CK2, a second electrode electrically connected to the second node N2, and a gate electrode electrically connected to the first node N1. The fourth transistor T4 applies the second clock signal CLK2 to the second node N2 according to an electric potential of the first node N1.

The fifth transistor T5 includes a first electrode connected to the first voltage line VL1, a second electrode electrically connected to the second node N2, and a gate electrode connected to the second clock line CK2. The fifth transistor T5 discharges the electric potential of the second node N2 to the first voltage VGL in response to the second clock signal CLK2.

The sixth transistor T6 includes a first electrode connected to the second voltage line VL2, a second electrode connected to the gate output line GOLk, and a gate electrode electrically connected to the second node N2. The sixth transistor T6 applies the second voltage VGH to the gate output line GOLk according to the electric potential of the second node N2.

The seventh transistor T7 includes a first electrode connected to the first clock line CK1, a second electrode connected to the gate output line GOLk, and a gate electrode electrically connected to the first node N1 via the eighth transistor T8. The seventh transistor T7 applies the first clock signal CLK1 to the gate output line GOLk according to an output of the eighth transistor T8.

The eighth transistor T8 includes a first electrode electrically connected to the first node N1, a second electrode connected to the gate electrode of the seventh transistor T7, and a gate electrode connected to the first voltage line VL1. The eighth transistor T8 applies a signal of the first node N1 to the gate electrode of the seventh transistor T7 in response to the first voltage VGL.

One end of the first capacitor C1 is connected to the gate electrode of the seventh transistor T7, and the other end of the first capacitor C1 is connected to the gate output line GOLk. One end of the second capacitor C2 is connected to the second voltage line VL2, and the other end of the second capacitor C2 is electrically connected to the second node N2.

During a low level period of the second clock signal CLK2, the first transistor T1 applies the (k−1)th gate output signal GOSk−1 provided thereto through the carry line CRk to the first node N1. The fourth transistor T4 connected to the first node N1 is turned on in response to the (k−1)th gate output signal GOSk−1, and the second clock signal CLK2 is applied to the second node N2 through the turned-on fourth transistor T4. In addition, the (k−1)th gate output signal GOSk−1 applied to the first node N1 is applied to the gate electrode of the seventh transistor T7 through the eighth transistor T8 turned-on in response to the first voltage VGL. Accordingly, the seventh transistor T7 applies the first clock signal CLK1 at a low state to the gate output line GOLk in response to the (k−1)th gate output signal GOSk−1. Therefore, the k-th gate output signal GOSk is controlled to have an activation level. The first capacitor C1 is connected to the gate electrode of the seventh transistor T7 and the second electrode of the seventh transistor T7 to maintain the activation level of the k-th gate output signal GOSk.

When the second clock signal CLK2 at a high state is applied to the second node N2 through the turned-on fourth transistor T4, the sixth transistor T6 is maintained in a turn-off state. Then, when the second clock signal CLK2 is transited to the low state, the sixth transistor T6 is turned on in response to the second clock signal CLK2 at the low state, and the second voltage VGH is applied to the gate output line GOLk through the turned-on sixth transistor T6. Accordingly, the k-th gate output signal GOSk is controlled to have a deactivation level. The second capacitor C2 is connected to the gate electrode of the sixth transistor T6 and the first electrode of the sixth transistor T6 to maintain the deactivation level of the k-th gate output signal GOSk.

Accordingly, the gate output signals GOS1 to GOSn have the same reference frequency RF as that of the first clock signal CLK1 and the second clock signal CLK2.

The second voltage VGH is applied to the gate output line GOLk connected to the second electrode of the sixth transistor T6 through the sixth transistor T6 that responses to the electric potential of the second node N2. Accordingly, the k-th gate output signal GOSk is controlled to have the deactivation level. The second capacitor C2 is connected to the gate electrode of the sixth transistor T6 and the first electrode of the sixth transistor T6 to maintain the deactivation level of the k-th gate output signal GOSk.

The second transistor T2 connected to the second node N2 is turned on in response to the second clock signal CLK2 at the low state, and the second voltage VGH is applied to the third transistor T3 connected to the second electrode of the second transistor T2 through the turned-on second transistor T2. Then, the second voltage VGH is applied to the first node N1 through the third transistor T3 that responses to the first clock signal CLK1 at the low state. Therefore, the k-th gate output signal GOSk at an activation state becomes stable. The fifth transistor T5 applies the first voltage VGL to the second node N2 in response to the second clock signal CLK2. As a result, the k-th gate output signal GOSk at a deactivation state becomes stable.

Referring to FIGS. 6, 7A, and 7B, the k-th masking circuit MCk receives the second voltage VGH from the second voltage line VL2 and receives the k-th gate output signal GOSk from the gate output line GOLk. The k-th masking circuit MCk includes a masking line ML. The masking line ML receives the masking signal MS. The k-th masking circuit MCk outputs the k-th scan signal SSk to a k-th scan line SLk. For the convenience of explanation, the k-th scan line SLk will be also referred to as a "scan line SLk" in descriptions with reference to FIG. 6.

In the illustrated embodiment, the ninth transistor T9 includes a first electrode connected to the second voltage line VL2, a second electrode connected to the scan line SLk, and a gate electrode electrically connected to the second node N2. The ninth transistor T9 applies the second voltage VGH to the scan line SLk according to the electric potential of the second node N2.

The tenth transistor T10 includes a first electrode connected to the masking line ML, a second electrode connected to the scan line SLk, and a gate electrode connected to the gate output line GOLk. The tenth transistor T10 is turned on in response to the gate output signal GOSk and applies the masking signal MS to the scan line SLk.

When the ninth transistor T9 is turned on according to the electric potential of the second node N2, the second voltage VGH is applied to the scan line SLk through the turned-on ninth transistor T9. Accordingly, the k-th scan signal SSk is controlled to have the deactivation level. That is, the ninth transistor T9 and the sixth transistor T6 are substantially simultaneously turned on, and thus, the k-th gate output signal GOSk and the k-th scan signal SSk are substantially simultaneously deactivated. The tenth transistor T10 is turned on in response to the activated k-th gate output signal GOSk. In this case, the masking signal MS is applied to the scan line SLk connected to a second electrode of the tenth transistor T10. The masking signal MS includes masking sections that mask the gate output signals GOS1 to GOSn and non-masking sections that do not mask the gate output signals GOS1 to GOSn. In the masking section of the masking signal MS applied to the scan line SLk, the k-th scan signal SSk is controlled to have the deactivation level. In the non-masking section of the masking signal MS applied to the scan line SLk, the k-th scan signal SSk is controlled to have the activation level. The k-th scan signal SSk has substantially the same frequency as a frequency of the non-masking section of the masking signal MS.

Although the k-th scan signal SSk is controlled to have the deactivation level by the masking signal MS, the k-th gate output signal GOSk output from the k-th gate driving circuit GDCk is provided as the carry signal of the (k+1)th gate driving circuit GDCk+1. In the low-frequency mode LFM (refer to FIG. 4B), the gate output signals GOS1 to GOSn have substantially the same reference frequency RF as that of the first clock signal CLK1 and the second clock signal CLK2. Even though the gate output signals GOS1 to GOSn have the reference frequency RF in the low-frequency mode LFM, the scan signals SS1 to SSn may have the first or second frequency RF1 or RF2 lower than the reference frequency RF.

Referring to FIGS. 5, 7A, and 7B, the gate output signals GOS1 to GOSn are signals having the reference frequency RF and output from the gate driver GDP.

The masking unit MP masks the gate output signals GOS1 to GOSn using the masking signal MS and outputs the scan signals SS1 to SSn having the frequency lower than the reference frequency RF. A section in which the masking signal MS has the low level corresponds to the non-masking section in which the gate output signals GOS1 to GOSn are not masked. A section in which the masking signal MS has the high level corresponds to the masking section in which the gate output signals GOS1 to GOSn are masked. As shown in FIG. 7A, the masking signal MS includes a first non-masking section NMW1 that does not mask the gate output signals GOS1 to GOSk corresponding to the first area DA1 of the display panel DP, the first masking section MSW1 that masks the gate output signals GOS1 to GOSk corresponding to the first area DA1 of the display panel DP, a second non-masking section NMW2 that does not mask the gate output signals GOSk+1 to GOSn corresponding to the second area DA2 of the display panel DP, and the second masking section MSW2 that masks the gate output signals GOSk+1 to GOSn corresponding to the second area DA2 of the display panel DP. In this case, the masking unit MP masks the gate output signals GOS1 to GOSk corresponding to the first area DA1 during the first masking section MSW1 and outputs the first group scan signal SSF1 including the scan signals SS1 to SSk having the first frequency RF1. In addition, the masking unit MP masks the gate output signals GOSk+1 to GOSn corresponding to the second area DA2 during the second masking section MSW2 and outputs the second group scan signal SSF2 including the scan signals SSk+1 to SSn having the second frequency RF2.

However, the invention should not be limited thereto or thereby, and the masking signal MS may further include a third non-masking section that does not mask gate output signals corresponding to the third area and a third masking section that masks the gate output signals corresponding to the third area. In addition, when the display device DD (refer to FIG. 1) is operated in the low-frequency mode LFM, the gate driver GDP outputs the gate output signals GOS1 to GOSn having the first frequency RF1. In this case, the gate output signals GOS1 to GOSk corresponding to the first area DA1 of the display panel DP are not needed to be masked by the masking signal MS. Accordingly, the masking signal MS may include only the first and second non-masking sections NMW1 and NMW2 and the second masking section MSW2 that masks the gate output signals GOSk+1 to GOSn corresponding to the second area DA2 of the display panel DP.

Figure 8:
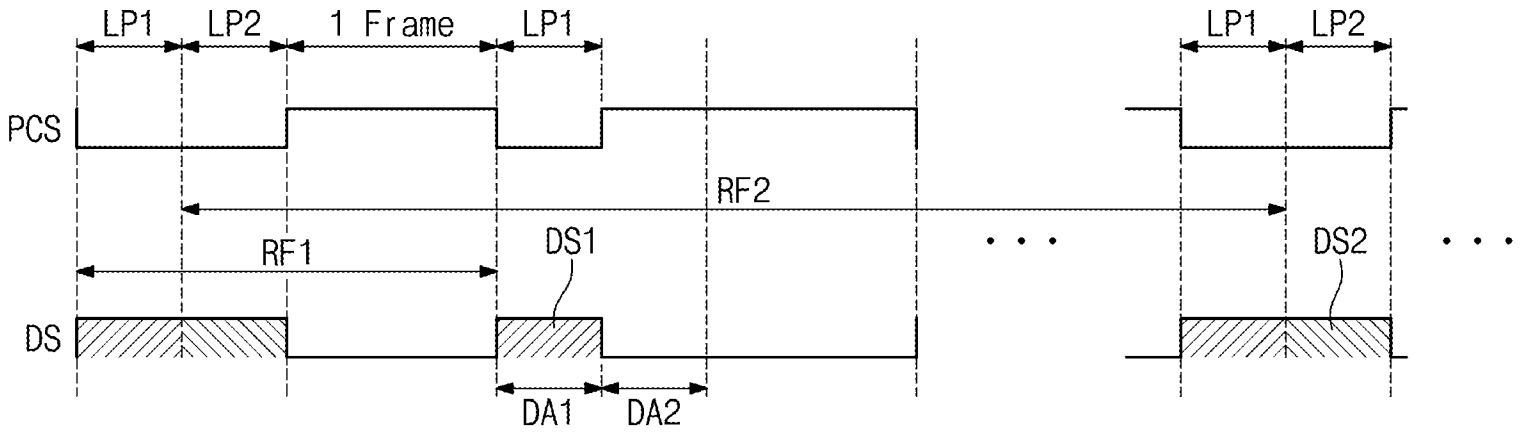
FIG. 8 is a timing diagram showing an embodiment of an operation of a source driving block according to the invention.

FIG. 8 is a timing diagram showing an embodiment of an operation of the source driving block according to the invention.

Referring to FIGS. 3, 4A, 4B, and 8, the source driver SDP converts the image data IMD to the data signals DS in response to the power control signal PCS and the source driving signal SDS. The source driver SDP may not apply the data signals DS to the display panel DP in response to the power control signal PCS. In detail, the source driver SDP may not apply the data signals DS to the display panel DP in the high level period of the power control signal PCS and may apply the data signals DS to the display panel DP in the low level period of the power control signal PCS.

In the normal mode NM, the power control signal PCS is maintained in the low level. In the low-frequency mode LFM, the power control signal PCS includes the low level period and the high level period, which are generated at a predetermined frequency. In the low-frequency mode LFM, the power control signal PCS includes a first low level period LP1 generated at the first frequency RF1 and a second low level period LP2 generated at the second frequency RF2. The source driver SDP outputs the first data signals DS1 corresponding to the first area DA1 of the display panel DP during the first low level period LP1 of the power control signal PCS and outputs the second data signals DS2 corresponding to the second area DA2 of the display panel DP during the second low level period LP2 of the power control signal PCS. Accordingly, the first data signals DS1 are output at the first frequency RF1 by the first low level period LP1 generated at the first frequency RF1, and the second data signals DS2 are output at the second frequency RF2 by the second low level period LP2 generated at the second frequency RF2.

As shown in FIG. 8, the source driver SDP outputs the first data signals DS1 at the first frequency RF1 to the first area DA1 in response to the power control signal PCS. The source driver SDP outputs the second data signals DS2 at the second frequency RF2 to the second area DA2 in response to the power control signal PCS. The source driver SDP applies the data signals DS to the first area DA1 of the display panel DP at the first frequency RF1 lower than the reference frequency RF and applies the data signals DS to the second area DA2 of the display panel DP at the second frequency RF2 lower than the reference frequency RF. When the display device DD is operated in the low-frequency mode LFM, the low-frequency area LAR includes the first area DA1 and the second area DA2. In this case, when compared with the case where only the first data signals DS1 are applied to the low-frequency area LAR of the display panel DP at the first frequency RF1, the power consumption of the display device DD may be reduced when the first data signals DS1 are applied to the first area DA1 of the display panel DP at the first frequency RF1 and the second data signals DS2 are applied to the second area DA2 of the display panel DP at the second frequency RF2.

In detail, referring to FIGS. 4A, 4B, 5, 7 and 8, in the low-frequency mode LFM, the display device DD outputs the first and second group scan signals SSF1 and SSF2 to the first and second areas DA1 and DA2 in which the first and second images IM1 and IM2 are respectively displayed, through the gate driving block GDB, respectively. Therefore, the first and second images IM1 and IM2 displayed in the display panel DP are displayed without interruption or flickering. In this case, the display device DD applies the first and second data signals DS1 and DS2 to the first and second areas DA1 and DA2 of the display panel DP, respectively, at the first and second frequencies RF1 and RF2 of the first and second group scan signals SSF1 and SSF2 using the source driving block SDB. Accordingly, the source driving block SDB may apply the first and second data signals DS1 and DS2 to the display panel DP at the first frequency RF1 lower than the reference frequency RF and at the second frequency RF2 lower than the first frequency RF1, respectively. Accordingly, in the low-frequency mode LFM, the power that is consumed to convert and to output the data signals DS may be reduced compared with when the display device DD applies reference data signals DSR (refer to FIG. 13) to the display panel DP at the reference frequency RF or applies the first data signals DS1 to the display panel DP only at the first frequency RF1.

The source driving block SDB should not be limited thereto or thereby. Although the second area DA2 of the display panel DP includes two or more areas spaced apart from each other in the second direction DR2 in the display panel DP, the second data signals DS2 may be applied to each area at the second frequency RF2. In addition, when the display panel DP further includes the third area driven at the third frequency lower than the second frequency RF2, the third data signals may be output to the third area at the third frequency.

Figure 9:
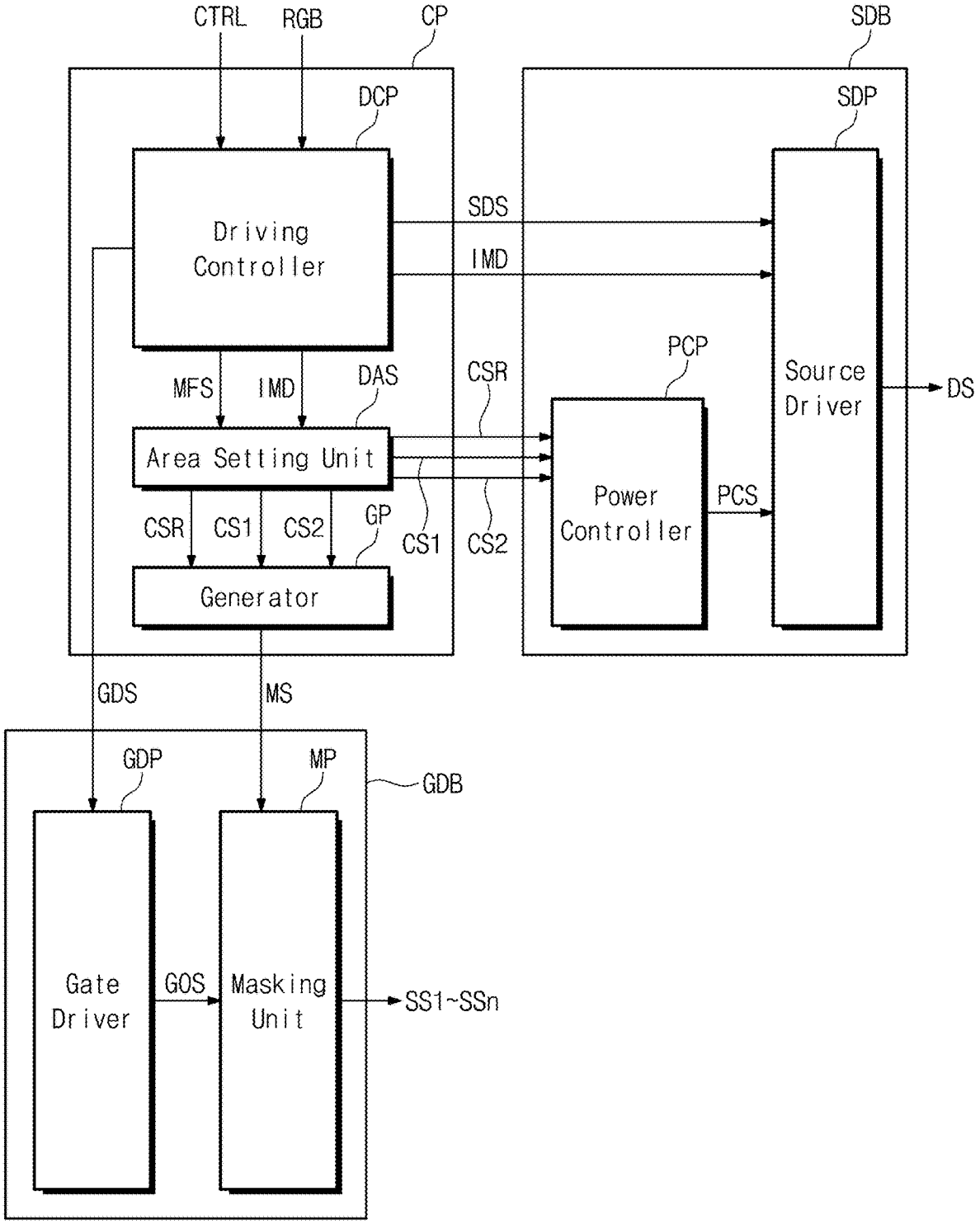
FIG. 9 is a block diagram showing an embodiment of a controller, a gate driving block, and a source driving block according to the invention.
Figure 10A:
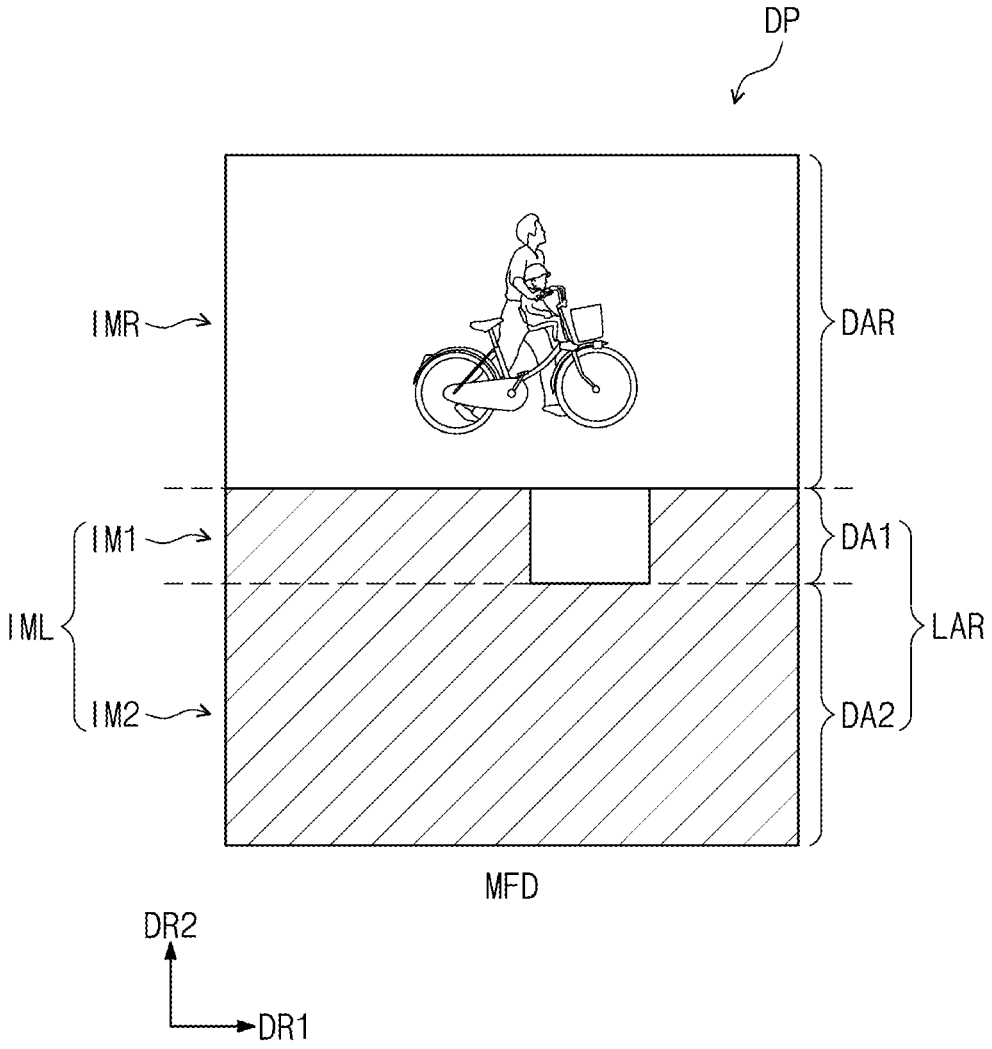
FIG. 10A is a plan view showing an embodiment of a display panel according to the invention.
Figure 10B:
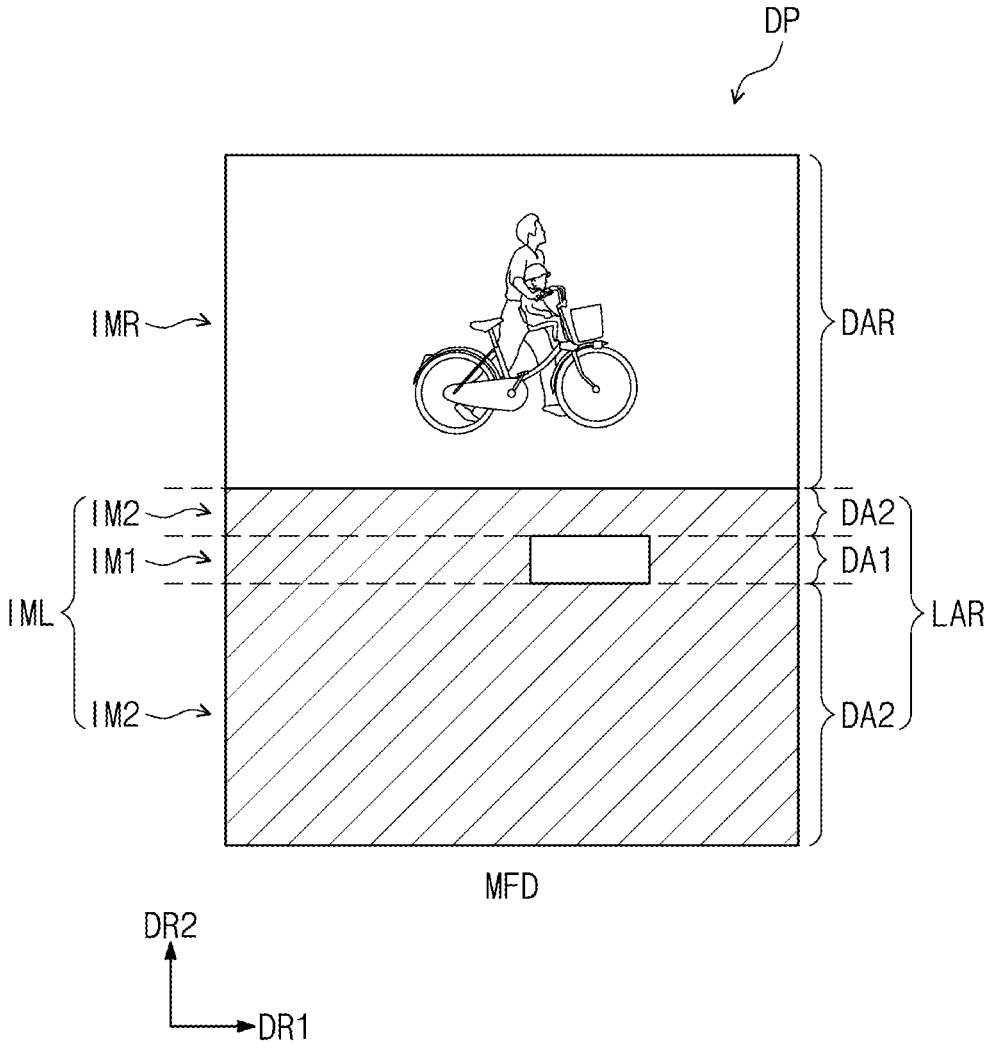
FIG. 10B is a plan view showing an embodiment of a display panel according to the invention.

FIG. 9 is a block diagram showing an embodiment of a controller CP, a gate driving block GDB, and a source driving block SDB according to the invention. FIGS. 10A and 10B are plan views showing an embodiment of a display panel according to the invention.

Referring to FIGS. 9, 10A, and 10B, the controller CP includes a driving controller DCP, an area setting unit DAS, and a generator GP.

The driving controller DCP receives image signals RGB and an external control signal CTRL. The driving controller DCP generates a gate driving signal GDS and a source driving signal SDS from the external control signal CTRL to respectively control the gate driving block GDB and the source driving block SDB. The display device in the illustrated embodiment of the invention may be operated in the normal mode NM (refer to FIG. 4A) in which the entire area of the display panel is operated at one frequency and in a multiple-frequency driving mode MFD in which the display panel includes a plurality of areas operated at different frequencies from each other. The driving controller DCP generates a multiple-frequency driving signal MFS in the multiple-frequency driving mode MFD. That is, the multiple-frequency driving signal MFS is deactivated in the normal mode NM and activated in the multiple-frequency driving mode MFD.

The area setting unit DAS receives image data IMD and the multiple-frequency driving signal MFS from the driving controller DCP. The area setting unit DAS is turned off in the normal mode NM in response to the deactivated multiple-frequency driving signal MFS and turned on in the multiple-frequency driving mode MFD in response to the activated multiple-frequency driving signal MFS. In the multiple-frequency driving mode MFD, the area setting unit DAS may divide the display panel DP into a reference area DAR and a low-frequency area LAR based on the image data IMD. The reference area DAR is an area in which a reference image IMR is displayed at a reference frequency RF (refer to FIG. 12B), and the low-frequency area LAR is an area in which the low-frequency image IML is displayed at a frequency lower than the reference frequency RF. In an embodiment of the invention, the low-frequency area LAR includes first and second areas DA1 and DA2. The first area DA1 is an area in which a first image IM1 is driven at a first frequency RF1 (refer to FIG. 12B) lower than the reference frequency RF, and the second area DA2 is an area in which a second image IM2 is driven at a second frequency RF2 (refer to FIG. 12B) lower than the first frequency RF1. In this case, the reference frequency RF is about 1 Hz, the first frequency RF1 is an ultra-low frequency lower than about 1 Hz, and the second frequency RF2 is an ultra-low frequency lower than the first frequency RF1.

The area setting unit DAS generates and outputs the control signals CS (refer to FIG. 2) in response to the multiple-frequency driving signal MFS. The control signals CS includes a reference control signal CSR, a first control signal CS1, and a second control signal CS2. The reference control signal CSR is a signal that drives the reference area DAR at the reference frequency RF, the first control signal CS1 is a signal that drives the first area DA1 at the first frequency RF1, and the second control signal CS2 is a signal that drives the second area DA2 at the second frequency RF2.

In FIG. 9, the driving controller DCP and the area setting unit DAS are shown as separate components, however, they should not be limited thereto or thereby. The area setting unit DAS may be included in the driving controller DCP. In this case, the control signals CS may be output from the driving controller DCP.

The generator GP receives the reference control signal CSR, the first control signal CS1, and the second control signal CS2. The generator GP generates a masking signal MS based on the reference control signal CSR, the first control signal CS1, and the second control signal CS2. The masking signal MS is a signal that controls a frequency of scan signals SS1 to SSn generated by the gate driving block GDB. The masking signal MS is applied to a masking unit MP of the gate driving block GDB. The masking signal MS is commonly applied to masking circuits MC1 to MCn (refer to FIG. 11) of the masking unit MP.

Referring to FIG. 9, the source driving block SDB includes a power controller PCP and a source driver SDP.

The power controller PCP receives the reference control signal CSR, the first control signal CS1, and the second control signal CS2 from the controller CP. The power controller PCP generates a power control signal PCS based on the reference control signal CSR, the first control signal CS1, and the second control signal CS2.

Referring to FIGS. 10A and 10B, when the reference image IMR and the low-frequency image IML are displayed through the display panel DP, the low-frequency area LAR in which the low-frequency image IML is displayed may be driven at a frequency lower than the reference frequency RF. The low-frequency image IML may include the first image IM1 that includes a predetermined grayscale pattern and the second image IM2 that does not include the predetermined grayscale pattern. The display device DD may drive a reference area DAR in which the reference image IMR is displayed at the reference frequency RF, may drive the first area DA1 in which the first image IM1 is displayed at the first frequency RF1, and may drive the second area DA2 in which the second image IM2 is displayed at the second frequency RF2. The first frequency RF1 may have the frequency lower than the reference frequency RF, and the second frequency RF2 may have the frequency lower than the first frequency RF1. The reference image IMR may be an image that is displayed without interruption or flickering even though the reference area DAR is driven at the reference frequency RF. The first image IM1 may be an image that is displayed without interruption or flickering even though the first area DA1 is driven at the first frequency RF1 lower than the reference frequency RF. The second image IM2 may be an image that is displayed without interruption or flickering even though the second area DA2 is driven at the second frequency RF2 lower than the first frequency RF1. When the reference area DAR driven at the reference frequency RF and at least one of the first and second areas DA1 and DA2 driven at the first and second frequencies RF1 and RF2 lower than the reference frequency RF are in the display panel DP, the display device DD may be operated in a multiple-frequency driving mode MFD. In the multiple-frequency driving mode MFD, the driving controller DCP may generate the multiple-frequency driving signal MFS that is activated.

Referring to FIG. 10B, the display panel DP may include the reference area DAR, the first area DA1, and a plurality of second areas DA2. In an embodiment of the invention, the second areas DA2 include two or more areas spaced apart from each other in the second direction DR2 with the first area DA1 interposed therebetween in the display panel DP. However, the invention should not be limited thereto or thereby, and the display panel DP may include a plurality of reference areas DAR or a plurality of first areas DA1. In an embodiment, the display panel DP may further include a third area in which a third image is displayed. The third area may be driven at a third frequency different from the reference frequency RF, the first frequency RF1, and the second frequency RF2. In an embodiment of the invention, the third image may be an image that is displayed without interruption or flickering even though the third area is driven at a frequency lower than the second frequency RF2.

Figure 11:
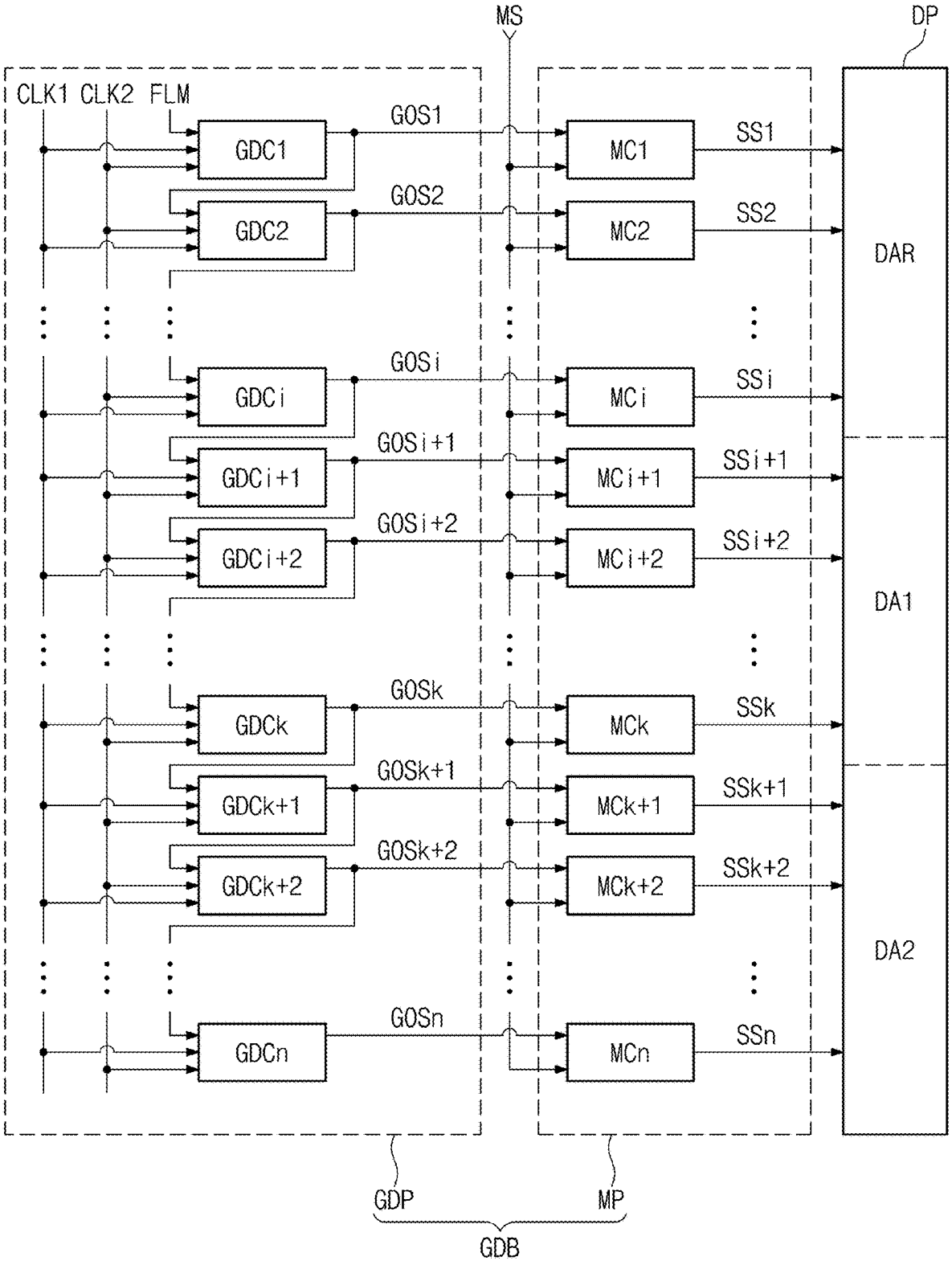
FIG. 11 is a block diagram showing an embodiment of a gate driving block according to the invention.
Figure 12A:
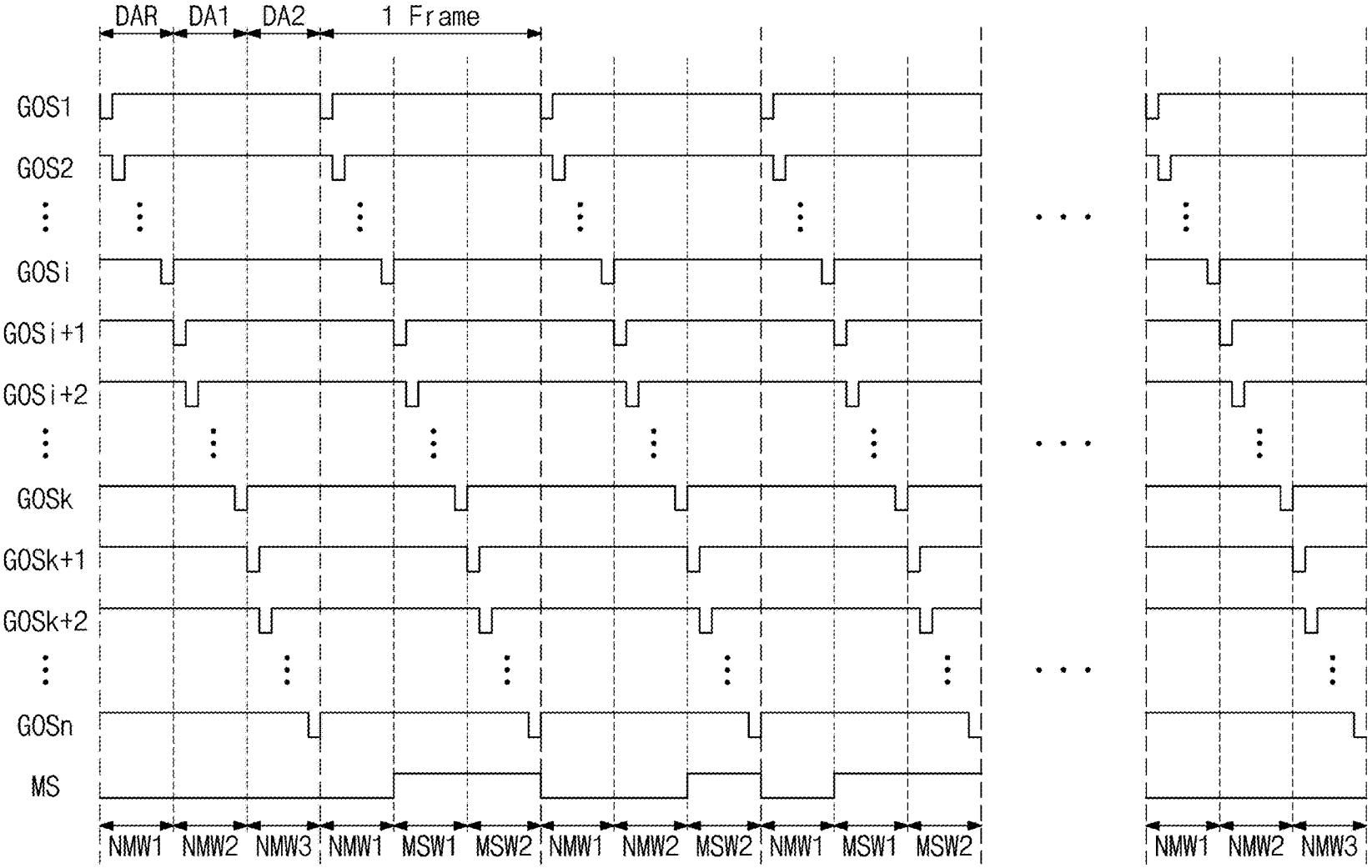
FIG. 12A is a timing diagram showing an embodiment of an operation of a gate driving block according to the invention.
Figure 12B:
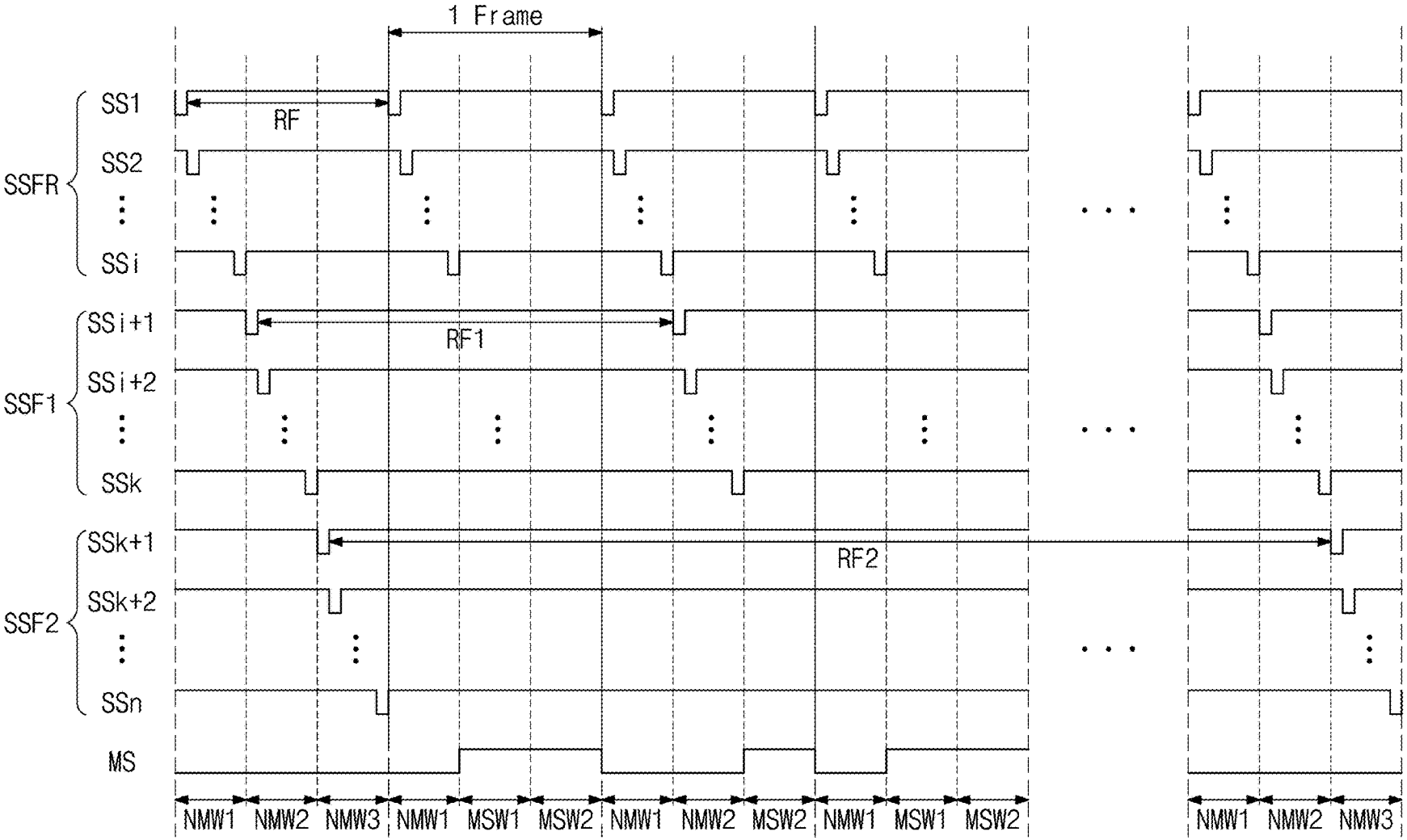
FIG. 12B is a timing diagram showing an embodiment of an output of scan signals according to the operation of the gate driving block of FIG. 12A.

FIG. 11 is a block diagram showing an embodiment of a gate driving block GDB in an embodiment of the invention, and FIG. 12A is a timing diagram showing an embodiment of an operation of the gate driving block GDB according to the invention. FIG. 12B is a timing diagram showing an embodiment of an output of scan signals according to the operation of the gate driving block of FIG. 12A.

Referring to FIGS. 11, 12A, and 12B, the gate driving block GDB includes a gate driver GDP and a masking unit MP. Since a plurality of stages GDC1 to GDCn of the gate driver GDP and masking circuits MC1 to MCn of the masking unit MP shown in FIG. 11 have substantially the same configurations as those of the stages GDC1 to GDCn of the gate driver GDP and the masking circuits MC1 to MCn of the masking unit MP shown in FIG. 5, the same reference numerals are used to refer to the same components, and details on the same components are omitted. Hereinafter, for convenience of description, the stages GDC1 to GDCn are also referred to as gate driving circuits GDC1 to GDCn.

The masking signal MS is a signal that controls the frequency of the scan signals SS1 to SSn generated by the gate driving block GDB. When the gate driver GDP outputs gate output signals GOS1 to GOSn having the reference frequency RF, the masking unit MP does not mask gate output signals GOS1 to GOSi corresponding to the reference area DAR of the display panel DP and outputs a reference group scan signal SSFR including scan signals SS1 to SSi having the reference frequency RF. In addition, the masking unit MP masks gate output signals GOSi+1 to GOSk corresponding to the first area DA1 of the display panel DP and outputs a first group scan signal SSF1 including scan signals SSi+1 to SSk having the first frequency RF1. The masking unit MP masks gate output signals GOSk+1 to GOSn corresponding to the second area DA2 of the display panel DP and outputs a second group scan signal SSF2 including scan signals SSk+1 to SSn having the second frequency RF2. The masking signal MS includes a first masking section MSW1 that masks the gate output signals GOSi+1 to GOSk corresponding to the first area DA1 and a second masking section MSW2 that masks the gate output signals GOSk+1 to GOSn corresponding to the second area DA2.

Referring to FIGS. 12A and 12B, the gate output signals GOS1 to GOSn are signals having the reference frequency RF and output from the gate driver GDP.

The masking signal MS includes masking sections that mask the gate output signals GOS1 to GOSn and non-masking sections that do not mask the gate output signals GOS1 to GOSn. A section in which the masking signal MS has the low level is also referred to as the non-masking section in which the gate output signals GOS1 to GOSn are not masked. A section in which the masking signal MS has the high level is also referred to as the masking section in which the gate output signals GOS1 to GOSn are masked. As shown in FIG. 12A, the masking signal MS includes a first non-masking section NMW1 in which the gate output signals GOS1 to GOSi corresponding to the reference area DAR of the display panel DP are not masked, includes a second non-masking section NMW2 in which the gate output signals GOSi+1 to GOSk corresponding to the first area DA1 of the display panel DP are not masked and a first masking section MSW1 in which the gate output signals GOSi+1 to GOSk corresponding to the first area DA1 of the display panel DP are masked, and includes a third non-masking section NMW3 in which the gate output signals GOSk+1 to GOSn corresponding to the second area DA2 of the display panel DP are not masked and a second masking section MSW2 in which the gate output signals GOSk+1 to GOSn corresponding to the second area DA2 of the display panel DP are masked. In this case, the masking unit MP does not mask the gate output signals GOS1 to GOSi (i is a natural number less than k) corresponding to the reference area DAR in the first non-masking section NMW1, and thus, the masking unit MP outputs the reference group scan signal SSFR including the scan signals SS1 to SSi having the reference frequency RF. The masking unit MP masks the gate output signals GOSi+1 to GOSk corresponding to the first area DA1 in the first masking section MSW1, and thus, the masking unit MP outputs the first group scan signal SSF1 including the scan signals SSi+1 to SSk having the first frequency RF1. In addition, the masking unit MP masks the gate output signals GOSk+1 to GOSn corresponding to the second area DA2 in the second masking section MSW2, and thus, the masking unit MP outputs the second group scan signal SSF2 including the scan signals SSk+1 to SSn having the second frequency RF2.

However, the invention should not be limited thereto or thereby. The masking signal MS may further include a fourth non-masking section in which the gate output signals corresponding to the third area are not masked and a third masking section in which the gate output signals corresponding to the third area are masked.

Figure 13:
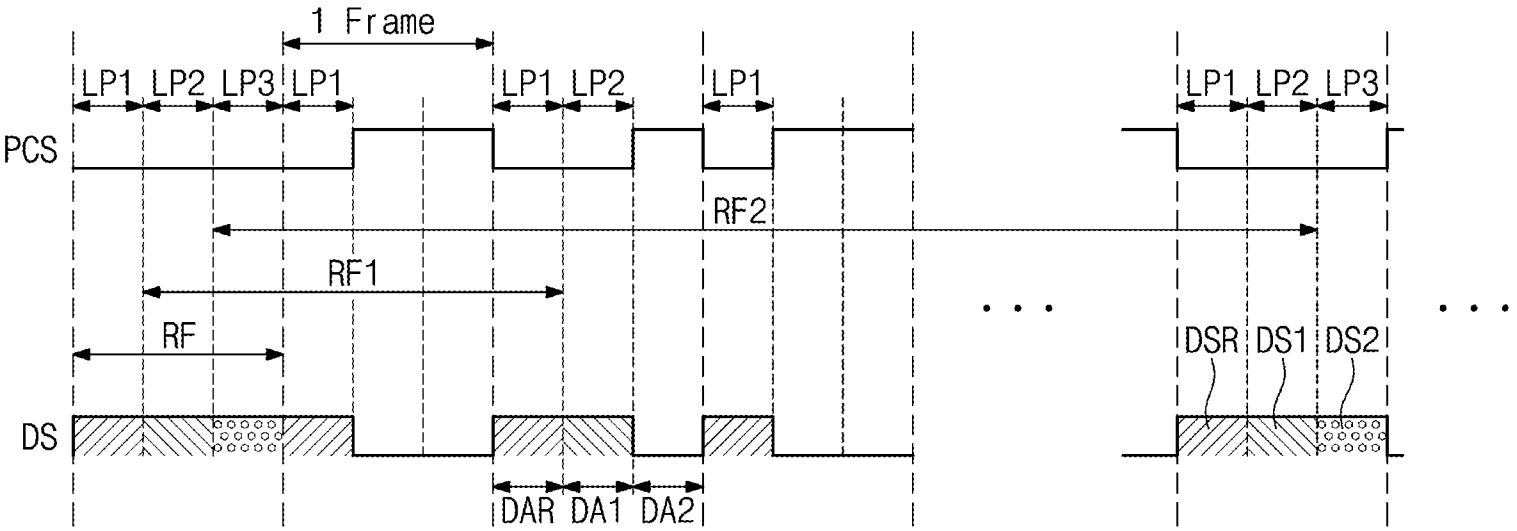
FIG. 13 is a timing diagram showing an embodiment of an operation of a source driving block according to the invention.

FIG. 13 is a timing diagram showing an embodiment of an operation of the source driving block according to the invention.

Referring to FIGS. 9, 10A, 10B, and 13, the source driver SDP may convert the image data IMD into the data signals DS in response to the power control signal PCS and the source driving signal SDS. The source driver SDP may not apply the data signals DS to the display panel DP according to the power control signal PCS. In detail, the source driver SDP may not apply the data signals DS to the display panel DP in a high level period of the power control signal PCS and may apply the data signals DS to the display panel DP in a low level period of the power control signal PCS.

In the normal mode NM, the power control signal PCS is maintained in the low level. In the multiple-frequency driving mode MFD, the power control signal PCS includes the low level periods and the high level periods, which are generated at a predetermined frequency. In the multiple-frequency driving mode MFD, the power control signal PCS includes a first low level period LP1 generated at the reference frequency RF, a second low level period LP2 generated at the first frequency RF1, and a third low level period LP3 generated at the second frequency RF2. The source driver SDP outputs reference data signals DSR corresponding to the reference area DAR of the display panel DP during the first low level period LP1 of the power control signal PCS, outputs the first data signals DS1 corresponding to the first area DA1 of the display panel DP during the second low level period LP2 of the power control signal PCS, and outputs the second data signals DS2 corresponding to the second area DA2 of the display panel DP during the third low level period LP3 of the power control signal PCS. Accordingly, the reference data signals DSR are output at the reference frequency RF by the first low level period LP1 generated at the reference frequency RF, the first data signals DS1 are output at the first frequency RF1 by the second low level period LP2 generated at the first frequency RF1, and the second data signals DS2 are output at the second frequency RF2 by the third low level period LP3 generated at the second frequency RF2.

The source driver SDP outputs the reference data signals DSR to the reference area DAR at the reference frequency RF in response to the power control signal PCS and outputs the first data signals DS1 to the first area DA1 at the first frequency RF1. In addition, the source driver SDP outputs the second data signals DS2 to the second area DA2 at the second frequency RF2 in response to the power control signal PCS. The source driver SDP applies the first data signals DS1 to the first area DA1 of the display panel DP at the first frequency RF1 lower than the reference frequency RF and applies the second data signals DS2 to the second area DA2 of the display panel DP at the second frequency RF2 lower than the first frequency RF1. When the display device DD is operated in the multiple-frequency driving mode MFD, the display area DA includes the reference area DAR and the low-frequency area LAR. The low-frequency area LAR includes the first area DA1 and the second area DA2. In this case, when compared with a case where only the first data signals DS1 are applied to the low-frequency area LAR of the display panel DP at the first frequency RF1, the power consumption of the display device DD may be reduced when the first data signals DS1 are applied to the first area DA1 at the first frequency RF1 and the second data signals DS2 are applied to the second area DA2 at the second frequency RF2.

Although the embodiments of the invention have been described, it is understood that the invention should not be limited to these embodiments but various changes and modifications may be made by one ordinary skilled in the art within the spirit and scope of the invention as hereinafter claimed.

Therefore, the disclosed subject matter should not be limited to any single embodiment described herein, and the scope of the invention shall be determined according to the attached claims.

What is claimed is:

1. A display device comprising:

a display panel which displays an image;

a gate driving block which outputs a scan signal to the display panel;

a source driving block which has a normal mode operated at a reference frequency and a low-frequency mode operated at a frequency lower than the reference frequency and outputs a data signal to the display panel; and a controller which receives image signals and an external control signal and generates a gate driving signal, a masking signal, a source driving signal, and image data in response to the image signals and the external control signal, wherein the controller comprises:

a driving controller which outputs a low-frequency control signal according to the normal mode operated at the reference frequency and the low-frequency mode operated at at least one of a first frequency and a second frequency lower than the reference frequency in response to the image data;

an area setting unit which divides the display panel into a first area and a second area in response to the low-frequency control signal and the image data and outputs a first control signal to drive the first area at the first frequency and a second control signal to drive the second area at the second frequency; and a generator which generates the masking signal in response to the first and second control signals, and the controller applies the gate driving signal and the masking signal to the gate driving block;

wherein the source driving block outputs the data signal to the first area at the first frequency and outputs the data signal to the second area at the second frequency in the low-frequency mode, and wherein the gate driving block outputs a first scan signal to the first area at the first frequency and outputs a second scan signal to the second area at the second frequency in the low-frequency mode, and wherein a change among the reference frequency, the first frequency of the first scan signal and the second frequency of the second scan signal is controlled by the masking signal.

2. The display device of claim 1, wherein the gate driving block comprises:

a gate driver which generates a gate output signal in response to the gate driving signal; and a masking unit which masks the gate output signal in response to the masking signal to output the scan signal.

3. The display device of claim 2, wherein the gate driver outputs the gate output signal at the reference frequency, the masking unit masks the gate output signal corresponding to the first area to output the first scan signal at the first frequency and masks the gate output signal corresponding to the second area to output the second scan signal at the second frequency, and the masking signal comprises:

a first masking section in which the gate output signal corresponding to the first area is masked; and a second masking section in which the gate output signal corresponding to the second area is masked.

4. The display device of claim 2, wherein the gate driver outputs the gate output signal at the first frequency in the low-frequency mode, the masking unit does not mask the gate output signal corresponding to the first area to output the first scan signal at the first frequency and masks the gate output signal corresponding to the second area to output the second scan signal at the second frequency, and the masking signal comprises a second masking section in which the gate output signal corresponding to the second area is masked.

5. The display device of claim 1, wherein the controller applies the image data, the source driving signal, and the first and second control signals to the source driving block, and the source driving block comprises:

a power controller which generates a power control signal in response to the first and second control signals; and a source driver which converts the image data into the data signal in response to the power control signal and the source driving signal.

6. The display device of claim 1, wherein the first frequency is equal to or lower than about 1 Hertz.

7. The display device of claim 1, wherein the second area comprises at least two areas.

8. A display device comprising:

a display panel which displays an image;

a gate driving block which outputs a scan signal to the display panel;

a source driving block which outputs a data signal to the display panel; and a controller which receives image signals and an external control signal and generates a gate driving signal, a masking signal, a source driving signal, and image data in response to the image signals and the external control signal, wherein the controller comprises:

an area setting unit which divides the display panel into a reference area and a low-frequency area according to the image data, divides the low-frequency area into a first area and a second area, and outputs a reference control signal to drive the reference area at a reference frequency, a first control signal to drive the first area at a first frequency, and a second control signal to drive the second area at a second frequency; and a generator which generates the masking signal in response to the reference control signal and the first and second control signals, and the controller applies the gate driving signal and the masking signal to the gate driving block, wherein the source driving block outputs the data signal to the reference area at the reference frequency, outputs the data signal to the first area at the first frequency, and outputs the data signal to the second area at the second frequency, and wherein the gate driving block outputs a reference scan signal to the reference area at the reference frequency, outputs a first scan signal to the first area at the first frequency, and outputs a second scan signal to the second area at the second frequency, and wherein a change among the reference frequency, the first frequency of the first scan signal and the second frequency of the second scan signal is controlled by the masking signal.

9. The display device of claim 8, wherein the gate driving block comprises:

a gate driver which generates a gate output signal in response to the gate driving signal; and a masking unit which masks the gate output signal in response to the masking signal to output the scan signal.

10. The display device of claim 9, wherein the gate driver outputs the gate output signal at the reference frequency in the reference area and the first and second areas, the masking unit does not mask the gate output signal corresponding to the reference area to output the reference scan signal at the reference frequency, masks the gate output signal corresponding to the first area to output the first scan signal at the first frequency, and masks the gate output signal corresponding to the second area to output the second scan signal at the second frequency, and the masking signal comprises:

a first masking section in which the gate output signal corresponding to the first area is masked; and a second masking section in which the gate output signal corresponding to the second area is masked.

11. The display device of claim 10, wherein the first masking section has a frequency different from a frequency of the second masking section.

12. The display device of claim 8, wherein the controller applies the image data, the source driving signal, the reference control signal, and the first and second control signals to the source driving block.

13. The display device of claim 12, wherein the source driving block comprises:

a power controller which generates a power control signal in response to the reference control signal and the first and second control signals; and a source driver which converts the image data into the data signal in response to the power control signal and the source driving signal.

14. The display device of claim 8, wherein the reference frequency is equal to or lower than about 1 Hertz.

15. The display device of claim 8, wherein the second area comprises at least two areas.

* * * * *